US011695214B2

(12) United States Patent
Hong Loh et al.

(10) Patent No.: US 11,695,214 B2
(45) Date of Patent: Jul. 4, 2023

(54) REFLECTARRAY ANTENNA

(71) Applicant: NPL MANAGEMENT LIMITED, Middlesex (GB)

(72) Inventors: Tian Hong Loh, Teddington (GB); Ghulam Ahmad, Lahore (PK); Tim Brown, Guildford (GB); Craig Underwood, Guildford (GB)

(73) Assignee: NPL MANAGEMENT LIMITED, Teddington (GB)

( * ) Notice: Subject to any disclaimer, the term of this patent is extended or adjusted under 35 U.S.C. 154(b) by 61 days.

(21) Appl. No.: 17/258,082

(22) PCT Filed: Jul. 4, 2019

(86) PCT No.: PCT/GB2019/051897
§ 371 (c)(1),
(2) Date: Jan. 5, 2021

(87) PCT Pub. No.: WO2020/008201
PCT Pub. Date: Jan. 9, 2020

(65) Prior Publication Data

US 2021/0184362 A1 Jun. 17, 2021

(30) Foreign Application Priority Data

Jul. 5, 2018 (GB) ..... 1811092

(51) Int. Cl.
*H01Q 15/00* (2006.01)
*H01Q 3/46* (2006.01)
*H01Q 1/48* (2006.01)

(52) U.S. Cl.
CPC ..... *H01Q 15/002* (2013.01); *H01Q 1/48* (2013.01); *H01Q 3/46* (2013.01)

(58) Field of Classification Search
CPC ..... H01Q 1/48; H01Q 3/46; H01Q 15/002
See application file for complete search history.

(56) References Cited

U.S. PATENT DOCUMENTS 4,410,891 A * 10/1983 Schaubert ..... H01Q 21/245 343/700 MS
6,437,752 B1 * 8/2002 Chekroun ..... H01Q 5/45 343/756
2008/0284674 A1 * 11/2008 Herz ..... H01Q 21/065 343/909

OTHER PUBLICATIONS

Yang et al., "A 1-Bit 10×10 Reconfigurable Reflectarray Antenna: Design, Optiminzation, and Experiment"; IEEE Transactions on Antennas and Propagation. vol. 64, No. 6, Jun. 1, 2016, pp. 2246-2254, XP0011612664.

(Continued)

*Primary Examiner* — Daniel Munoz
(74) *Attorney, Agent, or Firm* — Thomas Horstemeyer, LLP

(57) ABSTRACT

Reflectarray antenna elements, reflectarrays, and a method of operating an antenna element are described. A reflectarray antenna element includes a patch (14) of electrically conductive material for reflecting an electromagnetic field; a dielectric substrate (12) providing an RF ground; first and second phase control lines (16, 18) of electrically conductive material arranged to interact with electromagnetic radiation with a first polarisation; a first binary switching device (24) having an ON or OFF state disposed between the patch and ground, and configured to selectively electrically couple the patch to ground via the first phase control line; a second binary switching device (26) having an ON or OFF state disposed between the patch and ground, and configured to selectively electrically couple the patch to ground via the second phase control line; a single DC bias input electrically coupled to the patch and configurable to different discrete voltage levels for selectively controlling the states of the switching devices. Selective operation of the first and second binary switching devices occurs by means of the DC bias input provides phase control of electromagnetic radiation dependent on the state of the switching devices.

(Continued)

Described is a phase control mechanism of unit cells to enable a reconfigurable/smart reflectarray platform.

21 Claims, 24 Drawing Sheets

(56) References Cited

OTHER PUBLICATIONS

Ahmad et al., "How Coarse is Too Coarse in Electrically Large Reflectarray Smart Antennas? A Phase Quantization Case Study at Millimeter Wave Bands," 2017 International Workshop on Electromagnetics: Applications and Student Innovation Competition, IEEE, May 30, 2017, pp. 135-137, XP033114802.
Communication Pursuant to Article 94(3) EPC for EP Patent Application No. 19 748 885.1 dated Feb. 2, 2023.
International Search Report and Written Opinion for PCT/GB2019/051897 dated Oct. 25, 2019.

* cited by examiner

Ground plane is visible. Also, the top layer stubs and via pads can be seen.

REFLECTARRAY ANTENNA

CROSS-REFERENCE TO RELATED APPLICATIONS

This application is a 35 U.S.C. § 371 National Stage Patent Application of, and claims priority to, Patent Cooperation Treaty Application number PCT/GB2019/051897, filed on 4 Jul. 2019, and entitled "REFLECTARRAY ANTENNA," which claims priority to and the benefit of Great Britain Patent Application Number 1811092.4 filed on 5 Jul. 2018, where both of these applications are incorporated herein by reference in their entirety.

TECHNICAL FIELD

The present invention relates to reflectarray antenna elements, reflectarrays, and a method of operating an antenna element.

BACKGROUND ART

High gain smart antennas are one of the key enabling technologies of next generation communication systems.

A smart reflectarray antenna requires its comprising unit cells to accommodate the necessary reconfiguration behaviour which usually gives rise to multiple operational states at unit cell level.

The reflectarray operates on the principle that a constant phase of the reflected field is achieved in a plane normal to the direction of the desired antenna main beam.

Switches such as PIN diodes and RF MEMS are typically used to electrically connect/disconnect metallic parts in order to introduce (discretized) changes in the geometry of the total radiating surface.

Examples of known designs of such elements are disclosed in: U.S. Pat. Nos. 7,071,888, 7,868,829, 9,099,775, "A Reconfigurable Slot Antenna With Switchable Polarization" Fries et al. IEEE Microwave and Wireless Components Letters Vol. 13 No. 11 Nov. 2003 pp. 490-492, "60-GHz Electrically Reconfigurable Reflectarray Using p-i-n Diode" Kamoda et al. IEEE MTT-S International Microwave Symposium Digest 2009 pp. 1177-1180.

SUMMARY OF THE INVENTION

The present invention seeks to provide an improved reflectarray antenna element, an improved reflectarray and a method of operating such an antenna element.

According to an aspect of the present invention, there is provided a reflectarray antenna element including:

a patch of electrically conductive material for reflecting an electromagnetic (EM) field;

a dielectric substrate providing an RF ground;

first and second phase control lines of electrically conductive material arranged to interact with electromagnetic radiation with a first polarisation;

a first binary switching device having an ON or OFF state disposed between the patch and ground, and configured to selectively electrically couple the patch to ground via the first phase control line;

a second binary switching device having an ON or OFF state disposed between the patch and ground, and configured to selectively electrically couple the patch to ground via the second phase control line;

a single DC bias input electrically coupled to the patch and configurable to different discrete voltage levels for selectively controlling the states of the switching devices;

wherein selective operation of the first and second binary switching devices by means of the DC bias input provides phase control of electromagnetic radiation dependent on the state of the switching devices.

Advantageously, operation of the first and second switching devices causes the reflectarray antenna element to generate phase controlled electromagnetic radiation at the first polarisation.

Preferably, the first and second phase control lines are arranged parallel to a first direction. In a practical embodiment, the patch has a length and a width, the first and second phase control lines are disposed in the first direction along one of the length and width of the patch. Advantageously, each line in the first direction has a length, enabling the first and second phase lines operate at a first frequency.

In a practical embodiment, the patch has two operative dimensions, a length and a width. The length of the patch with two phase lines make it capable to operate at first frequency F1. The width of patch with other two phased lines make the patch operate at another frequency F2. The design is flexible, such that the first and second frequencies may be the same or different.

In a practical embodiment, the dielectric substrate is configured with the patch on one side thereof and RF ground on the other side thereof. Ground is preferably provided by an electrically conductive layer substantially parallel to the patch.

In a preferred embodiment, the first phase control line is configured to be selectively electrically coupled to the patch by the first switching device and the second phase control line is configured to be selectively electrically coupled to the patch by the second switching device.

Advantageously, the first switching device is a first PIN diode having a diode direction from the patch to the ground; and the second switching device is a second PIN diode having a diode direction from the ground to the patch.

The antenna element preferably includes third and fourth phase control lines of electrically conductive material; a third binary switching device having an ON or OFF state disposed between the patch and ground and configured to selectively electrically couple the patch to ground via the third phase control line; a fourth binary switching device having an ON or OFF state disposed between the patch and ground and configured to selectively electrically couple the patch to ground via the fourth phase control line; wherein the single DC bias input provides for selectively controlling the states of the third and fourth switching devices.

Advantageously, the third and fourth phase control lines are arranged to interact with electromagnetic radiation with a second polarisation. Preferably, operation of the third and fourth binary switching devices causes the reflectarray antenna element to generate phase controlled electromagnetic radiation at the second polarisation.

Preferably, the third and fourth phase control lines are arranged parallel to a second direction.

In a practical embodiment, the patch has a length and a width, the first and second phase control lines are disposed in the or a first direction along one of the length and width of the patch and the third and fourth phase control lines are disposed in the second direction along the other of the length and width of the patch. The second direction advantageously has a length, enabling the third and fourth phase lines operate at a second frequency.

Preferably, the third phase control line is configured to be selectively electrically coupled to the patch by the third switching device and the fourth phase control line is configures to be selectively electrically coupled to the patch by the fourth switching device.

In a practical implementation, the third switching device is a third PIN diode having a diode direction from the patch to the ground; and the fourth switching device is a fourth PIN diode having a diode direction from the ground to the patch.

In a preferred embodiment, the DC bias input is offset from a centre of the patch in a first direction by a distance which reduces cross-polarisation of the first electromagnetic field and/or is offset from a centre of the patch in a second direction by a distance which reduces cross-polarisation of the second electromagnetic field. Advantageously, the first direction is a direction of polarisation of the first polarisation and/or the second direction is a direction of polarisation of the second polarisation.

The antenna element is advantageously configured to operate at millimetre waves (mm-waves). In the preferred implementation, the antenna element is configured to operate at two independent frequency bands, in which each frequency band has a centre frequency for which the patch with two phase lines is designed.

In an embodiment, the antenna element is configured to implement 1.5 bits phase control to provide three phase states for electromagnetic radiation with the first polarisation at the first frequency, and optionally also for electromagnetic radiation with the second polarisation at the second frequency, directly at the RF plane of the antenna element.

The antenna element may include a substrate structure including first and second layers, the patch being located in the first layer, the second layer being said ground.

Each of the phase control lines can be preferably electrically coupled to the ground layer through a conductive via linking the first and second layers. Each via may be a castellated hole.

Advantageously, the first and second layers are separated by a dielectric substrate.

The antenna element may include a third layer, wherein the DC bias input includes a conductive via linking the first and third layers without electrical connection to the ground layer. The DC bias input may be electrically coupled to a DC isolation element at the third layer. The DC isolation element can be any suitable shape to stop the RF signal to reach to the DC source and can be optionally located at the second layer.

The second layer is preferably between the first and third layers.

Advantageously, the second and third layers are separated by a dielectric substrate.

Each of the phase control lines is preferably electrically coupled to the ground layer through a conductive via linking the first and the second layers. This via can pass to the third layer for ease of fabrication. Each via may be a castellated hole.

According to another aspect of the present invention, there is provided a reflectarray including a plurality of antenna elements as specified and disclosed herein.

Preferably, for each antenna element: the antenna element includes a substrate structure including first and second layers, the patch is located in the first layer, the second layer is said ground, each of the phase control lines is electrically coupled to ground through a via linking the first and second layers.

In a preferred embodiment, wherein adjacent antenna elements share a via.

The reflectarray preferably includes a control system configured to control the voltage level of the DC bias input of each of the antenna elements.

Advantageously, wherein at least some of the antenna elements are configured to provide different reflection phase shifts from others.

In practice, phase control is provided for the electromagnetic (EM) radiation reflected from the unit cell. A large number of the unit cells may be employed to form a reflectarray that is illuminated by a feeding source. The EM waves originating from the feeding source are incident on the surface containing unit cells (array). This incident field is reflected by the unit cells. Before reflecting the EM field, each unit cell introduces a controlled phase shift in EM field based on the switch state.

According to another aspect of the present invention, there is provided a method of operating an antenna element as specified and disclosed herein including the steps of: controlling a DC bias signal to the DC bias input to provide a desired reflection phase control for electromagnetic radiation with the first polarisation at a first frequency and optionally also for electromagnetic radiation with the second polarisation at a second frequency.

According to another aspect of the present invention, there is provided a method of operating a reflectarray as specified and disclosed herein including the steps of: controlling a DC bias signal to the DC bias input of each of the reflectarray antenna elements to provide a desired reflection control for electromagnetic radiation with the first polarisation at the first frequency and optionally also for electromagnetic radiation with the second polarisation at the second frequency.

In embodiments, the patch has a first length perpendicular to a first polarisation direction, being a direction of polarisation of electromagnetic radiation with the first polarisation, the first phase control line length has a length in the first polarisation direction and the second phase control line length has a length in the first polarisation direction; wherein the first length of the patch and the lengths of the first and second phase control line lengths, are selected to provide desired frequency and reflection phase operation for electromagnetic radiation with the first polarisation.

In some embodiments, the patch has a second length perpendicular to a second polarisation direction, being a direction of polarisation of electromagnetic radiation with the second polarisation, the third phase control line length has a length in the second polarisation direction and the fourth phase control line length has a length in the second polarisation direction; wherein the second length of the patch and the lengths of the third and fourth phase control line lengths, are selected to provide desired frequency and reflection phase operation for electromagnetic radiation with the second polarisation.

In some embodiments, the first polarisation direction is substantially orthogonal to the second polarisation direction and/or the first direction as recited in the claims is substantially orthogonal to the second direction as recited in the claims.

According to another aspect of the invention, there is provided a unit cell for a reflectarray configured to provide 1.5 bit phase quantisation.

The market will need a huge number of low-cost, low-power smart reflectarrays over the coming decade with the introduction of 5G. With the severe spectrum shortage at conventional cellular frequencies, mm-wave frequency bands are of considerable interest. However, to achieve reconfiguration in high gain mm-waves, antennas present significant implementation challenges due to tiny geometrical features of individual antenna elements. At mm-wave bands, where electrical size of an individual antenna becomes very small, the inclusion of a reconfigurable mechanism in the antenna becomes a great challenge due to real estate constraints.

Embodiments of the invention are able to provide high gain mm-wave reflectarray smart antennas as a potential solution to the antenna systems needed for next generation cellular communication systems and satellite communication systems.

Embodiments of the invention can provide for low-loss implicitly integrated 1.5 phase quantization bits (i.e. three-state phase shifter operation) for mm-wave reflectarray unit cells.

Embodiments provide an electronically reconfigurable 1.5 bit phase quantized reflectarray antenna element.

The reflectarrays disclosed herein are a potential solution to achieve high gains and reconfiguration simultaneously at mm-waves.

Preferred embodiments provide phase quantization in reflectarrays to ease implementation at mm-waves with a unit cell which provides three phase states. Improvements can be achieved in implementing 1.5 bit phase control in unit cells which ultimately provides 2.4 dB higher gain at reflectarray level as compared to a single bit implementation. Therefore one can achieve the same gain as achieved by Kamoda et al. using a smaller aperture size of the reflectarray.

Embodiments disclosed herein can provide dual frequency dual polarization functions.

In some embodiments, the design topology provides for a unit cell to have three operational states for each polarization and frequency. A single DC line can be used to bias four switching devices for simultaneous dual polarization and dual frequency operation. It can use four PIN diodes per cell to achieve electronically steerable reflectarray.

Some embodiments utilize a technique to control the magnitude of cross polar fields. The technique addresses the issue of improving the polarization purity of a mm-wave reconfigurable unit cell intended for a smart reflectarray. DC biasing usually deteriorates the performance. With the technique, high polarization purity has been achieved in all the three states of this multi-state reconfigurable unit cell by exploiting the DC bias line.

BRIEF DESCRIPTION OF THE DRAWINGS

Embodiments of the invention are described below, by way of example only, with reference to the accompanying drawings, in which.

DESCRIPTION OF THE PREFERRED EMBODIMENTS

Figure 1:
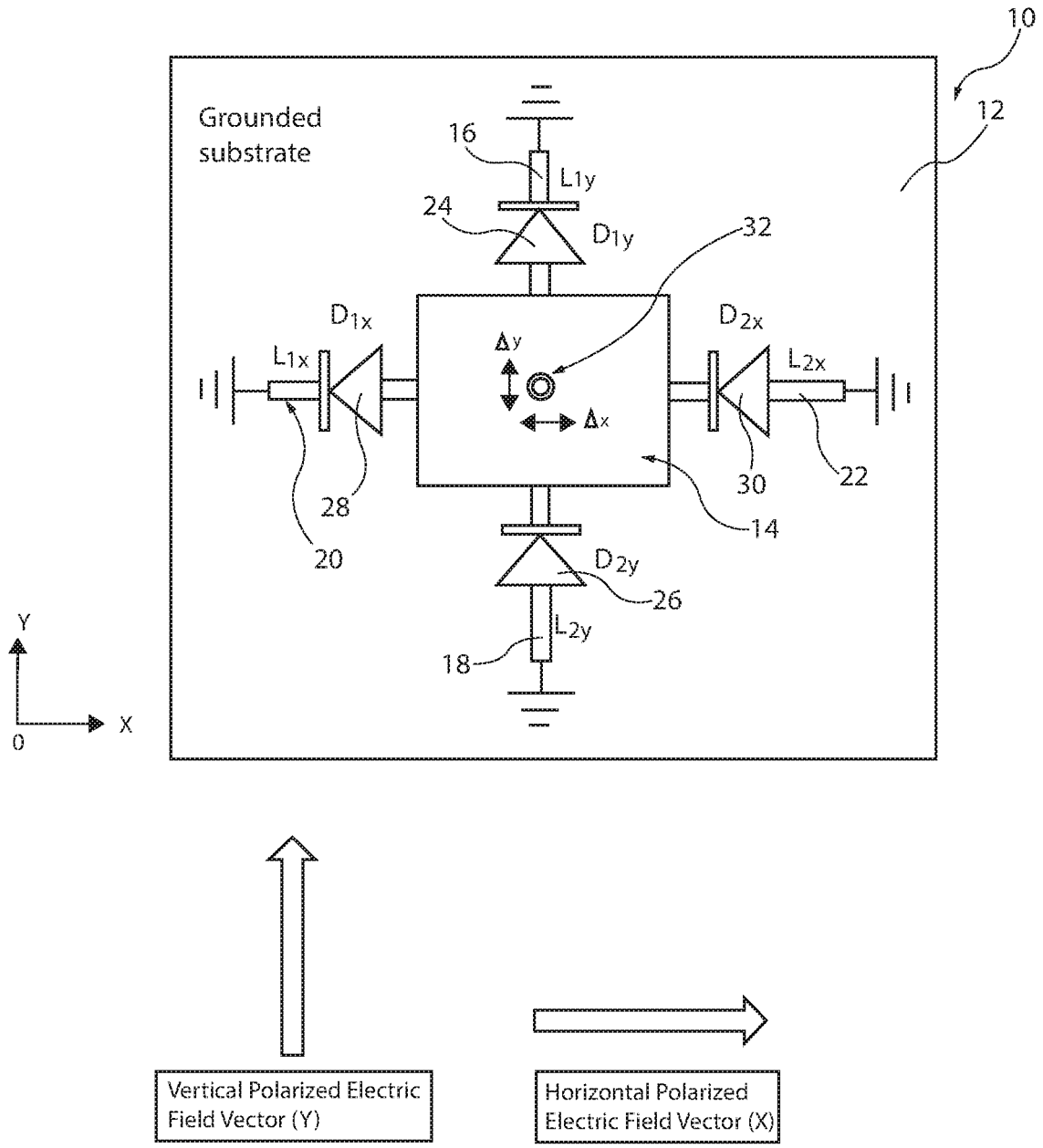
FIG. 1 shows a circuit diagram of a reflectarray antenna element according to an embodiment of the invention.

Next generation wireless communication systems are expected to support unprecedented extremely high data transfer rates. This objective requires wider bandwidths which are presently only available at the millimetre wave (mm-waves) spectrum (30-300 GHz). Additionally, mm-waves are an excellent candidate for air/space links due to the antenna physical aperture scaling with frequency. Due to stringent propagation impairments, mm-waves mainly rely on the line of sight communication links which require high gain and wide angle beam steering smart antennas to maintain their performance. High gain antenna solutions including reflector and phased arrays suffer significant disadvantages and are not an optimum solution at mm-waves. Due to complexity and losses in array beam formers, the realization of a high gain wide angle electronic beam steering antenna solution at mm-waves becomes a key challenge.

The developments disclosed herein provide a potentially competing high gain electronic beam steering antenna solution for mm-waves in the form of a phase quantized smart reflectarray. This was achieved by preserving the best features of phased arrays and reflector antennas in a reflectarray which spatially illuminates its active high performance unit cells. The reflected electromagnetic field from the reflectarray active surface is controlled by incorporating implicit phase control in unit cells directly at mm-waves to achieve significantly high performance. The resulting solution based on the disclosure herein is agile, simple to implement, do not necessarily require multiple RF chains, enables wide angle electronic beam steering (±78° cone), is scalable for any gain/frequency requirements, can be made foldable for smaller satellite platforms, is very reliable, and consumes low DC power. This smart reflectarray platform can implement any phase only synthesis technique for radiation pattern control including single/multiple pencil beams, contoured beams, and their scanning over wider angles. This disclosure would potentially benefit next generation terrestrial/air/space communication systems and radars.

Unit Cell Structure

Described below is an antenna element with a reconfigurable unit cell for mm-waves, 60 GHz. However, as described below, in other embodiments the dimensions can be selected for other wavelengths and frequencies.

As can be seen from the Figures, an embodiment of the invention provides a mm-waves unit cell 10 on a grounded substrate 12. In this embodiment, the grounded substrate is Rogers 5880, but other substrates can be used in other embodiments, preferably low loss substrates.

The unit cell 10 includes a patch 14 for reflecting an electromagnetic field. The patch is an electrically conductive layer or plate on top of the substrate 12. In this embodiment, the patch is copper, but other metallic or otherwise electrically conductive materials can be used in other embodiments.

The shape of Patch 14 is square as shown. However, the patch 14 can be any arbitrary shape as long as it is capable of reflecting the electromagnetic field of the required polarization.

In this embodiment, the antenna element is configured to operate with electromagnetic radiation having first and/or second linear polarisations polarized in first (y) and second (x) polarisation directions, respectively. The first and second polarization directions are preferably substantially orthogonal, although this is not essential. In this embodiment, the first polarization direction (y) is vertical and the second polarization direction (x) is horizontal. However, other directions can be used in other embodiments. In satellite communication mainly the polarizations are orthogonal. Similar is true for terrestrial applications.

Figure 9:
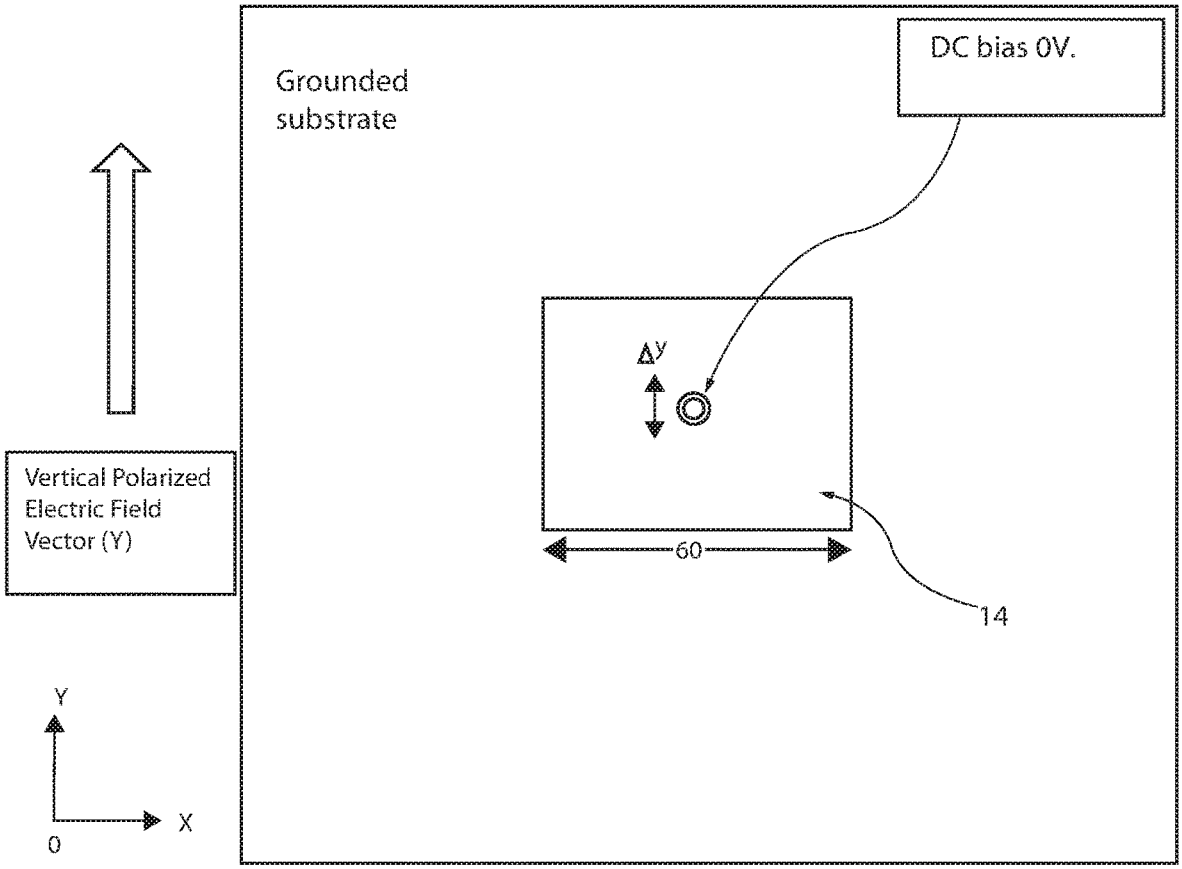
FIGS. 9 to 11 are top views of the reflectarray antenna element of FIGS. 1 to 8 showing only the portion of the unit cell which is responsible for vertical polarisation, and only those components which are electrically connected to the patch in different states.
Figure 16:
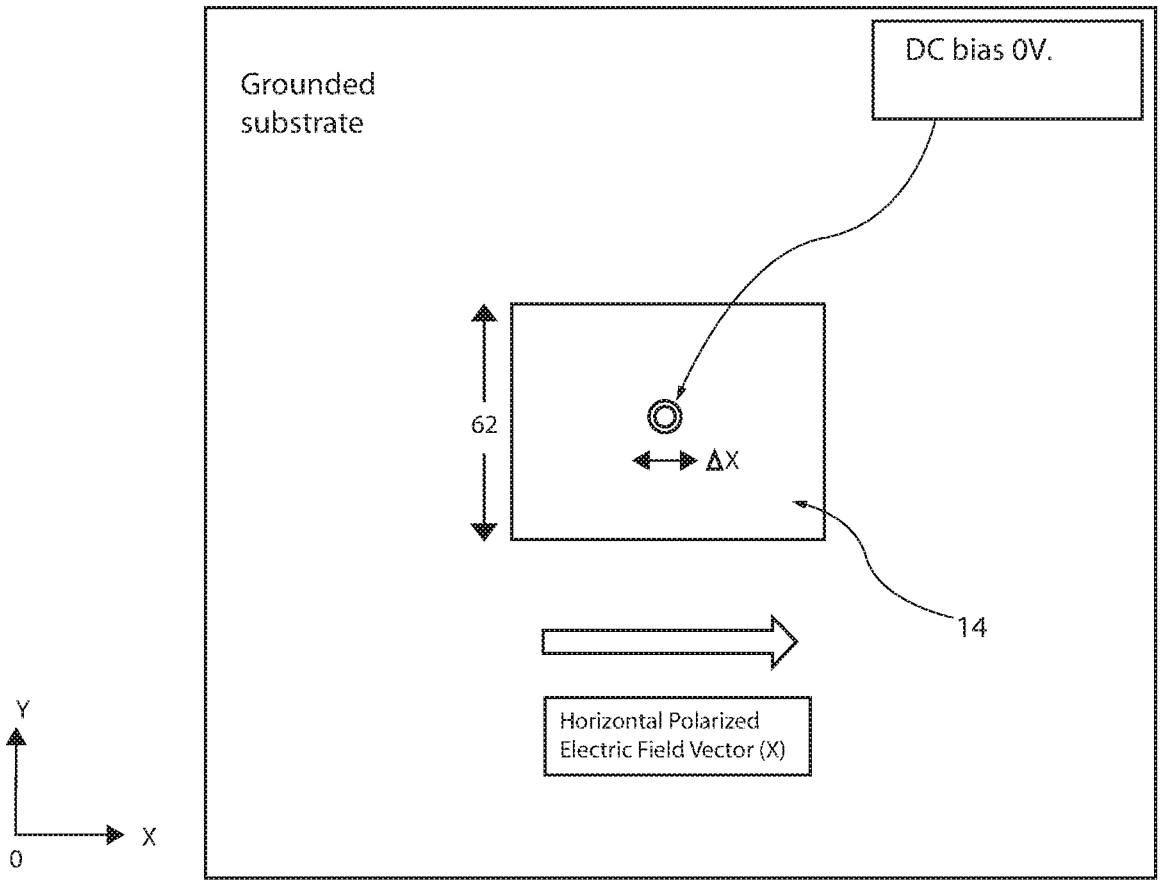
FIGS. 16 to 18 show top views of the reflectarray antenna element of FIGS. 1 to 11 and 15 showing only the portion of the unit cell which is responsible for horizontal polarisation, and only those components which are electrically connected to the patch in different states.

The patch 14 has a first length 60 perpendicular to the first polarisation direction and a second length 62 perpendicular to the second polarisation direction (see FIGS. 9 and 16).

The antenna element includes first 16, second 18, third 20 and fourth 22, phase control lines having respective lengths, also called stubs. These are electrically conductive stubs which in this embodiment are made of the same material as the patch 14, although they can be different materials in other embodiments. The first, second, third, and fourth phase control lines have lengths $L_{1Y}$, $L_{2Y}$, $L_{1X}$, $L_{2X}$ respectively. The first and second phase control lines $L_{1Y}$, $L_{2Y}$ are arranged to reflect electromagnetic fields of the first polarization. The third and fourth phase control lines $L_{1X}$, $L_{2X}$ are arranged to reflect electromagnetic fields of the second polarization.

The lengths of the phase control lines $L_{1Y}$-$L_{2X}$ are decided by the phase shift required. However, width is decided by impedance matching requirements. It is also a function of frequency which makes the impedance frequency dependent. In some embodiments widths of the phase control lines may be comparable to the width of PIN diode pad widths. PIN diode pads are discussed below.

In this embodiment, the lengths of the first and second phase control lines $L_{1Y}$, $L_{2Y}$ are in the first polarization direction, and the $L_{1X}$,$L_{2X}$ of the third and fourth phase control line lengths are in the second polarization direction. In other words, the lengths of the first and second phase control lines $L_{1Y}$, $L_{2Y}$ are parallel to a first direction and the lengths of the third and fourth phase control lines $L_{1X}$, $L_{2X}$ are parallel to a second direction. However, this is not necessary in all embodiments, provided they are arranged to reflect electromagnetic fields with the appropriate polarization.

In this embodiment, the first and second phase control lines $L_{1Y}$, $L_{2Y}$ are aligned, and the third and fourth phase control lines $L_{1X}$, $L_{2X}$ are aligned. However, alignment is not necessary in every embodiment as described in more detail below.

The first and second patch lengths 60, 62 and the lengths of the phase control lines $L_{1X}$, $L_{2X}$, $L_{1Y}$, $L_{2Y}$ are selected to provide the desired frequency and reflection phase behaviour as explained below.

In this embodiment $L_{1X}$=$L_{1Y}$ and $L_{2X}$=$L_{2Y}$ in order to provide similar performance for the first and second polarisations, in particular so that they exhibit the same frequency behaviour and can operate at the same frequency.

In this embodiment, the first and second phase control lines $L_{1Y}$, $L_{2Y}$ are located on opposite sides of the patch in the first polarization direction.

In this embodiment, the third and fourth phase control lines $L_{1X}$, $L_{2X}$ are located on opposite sides of the patch in the second polarization direction.

The antenna element includes first 24, second 26, third 28 and fourth 30, binary switching devices, in this embodiment PIN diodes, also called control devices, which in this embodiment are capable of digital biasing. By providing the digital bias simplifies the DC biasing circuits. The PIN diodes are either ON or OFF given +/−5 V or 0V. When PIN diodes are operated in ON/OFF fashion there is a less chance of variation due to temperature changes. Embodiments of the present invention are well suited for cases where temperature changes may be significant which limits the use of varactor diodes or phase change mechanisms.

Each of the PIN diodes 24-30 has a diode direction, which is the direction in which the diode is primarily able to be conductive for conventional current. Accordingly, the diode direction is from the anode to the cathode.

The first PIN diode 24 can selectively electrically couple the patch 14 to RF ground via the first phase control line length 16. The first PIN diode 24 has a diode direction from the patch to the first phase control line 16 ($L_{1Y}$). In this embodiment, the first PIN diode 24 is coupled between the patch and the first phase control line length 16 ($L_{1Y}$) and the first phase control line 16 ($L_{1Y}$) is coupled between the first PIN diode 24 and RF ground. The anode of the first PIN diode 24 is electrically connected to the patch 14, and the cathode of the first PIN diode 24 is electrically connected to the first phase control line 16 ($L_{1Y}$).

The second PIN diode 26 can selectively electrically couple the patch to RF ground via the second phase control line 18 ($L_{2Y}$). The second PIN diode 26 has a diode direction from the second phase control line 18 ($L_{2Y}$) to the patch 14. In this embodiment, the second PIN diode 26 is coupled between the patch and the second phase control line 18 ($L_{2Y}$) and the second phase control line 18 ($L_{2Y}$) is coupled between the second PIN diode 26 and RF ground. The cathode of the second PIN diode 26 is electrically connected to the patch 14, and the anode of the second PIN diode 26 is electrically connected to the second phase control line 18 ($L_{2Y}$).

The third PIN diode 28 can selectively electrically couple the patch to RF ground via the third phase control line 20 ($L_{1x}$). The third PIN diode 28 has a diode direction from the patch to the third phase control line 20 ($L_{1x}$). In this embodiment, the third PIN diode 28 is coupled between the patch and the third phase control line 20 ($L_{1x}$) and the third phase control line 20 ($L_{1x}$) is coupled between the third PIN diode 28 and RF ground. The anode of the third PIN diode 28 is electrically connected to the patch 14, and the cathode of the third PIN diode 28 is electrically connected to the third phase control line 20 ($L_{1x}$).

The fourth PIN diode 30 can selectively electrically couple the patch to RF ground via the fourth phase control line 22 ($L_{2x}$). The fourth PIN diode 30 has a diode direction from the fourth phase control line 22 ($L_{2x}$) to the patch 14. In this embodiment, the fourth PIN diode 30 is coupled between the patch and the fourth phase control line 22 ($L_{2x}$) and the fourth phase control line 22 ($L_{2x}$) is coupled between the fourth PIN diode 30 and RF ground. The cathode of the fourth PIN diode 30 is electrically connected to the patch 14, and the anode of the fourth PIN diode 30 is electrically connected to the fourth phase control line 22 ($L_{2x}$).

In FIG. 1, there appears to be shown a small section of phase control line between the patch 14 and the diodes 24-30; however, this is just for the clarity of the Figure. Nevertheless, in some embodiments, the PIN diodes can be located within the phase control lines so as to selectively complete the phase control lines and thereby couple the patch 14 to RF ground via the respective phase control lines.

Figure 2:
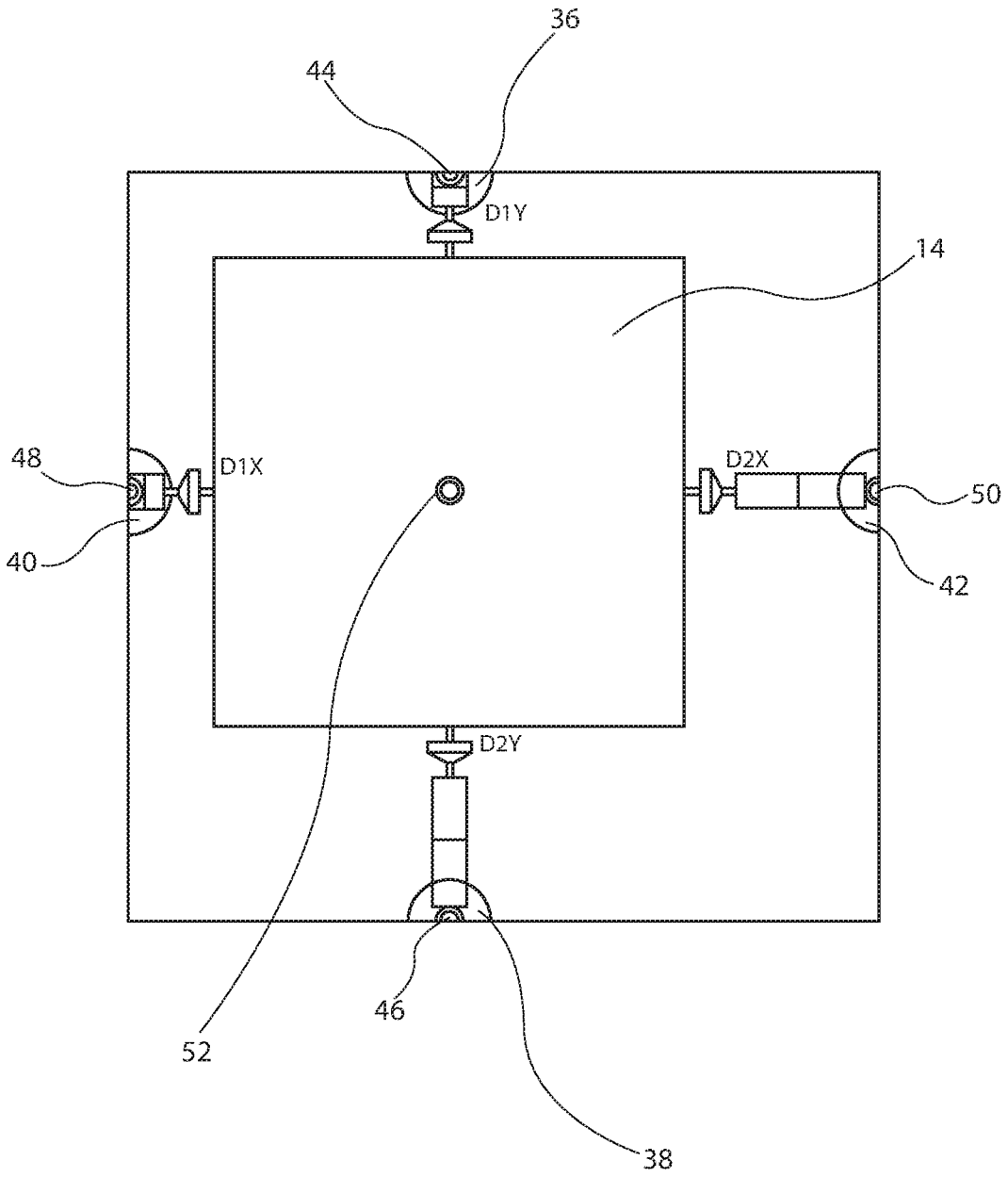
FIG. 2 shows a top view of the reflectarray antenna element of FIG. 1.

In this embodiment, each phase control line 16, 18, 20, 22 is coupled to RF ground via a respective pad 36, 38, 40, 42 at the end of the respective phase control line which is opposite to the end at which it is coupled to its respective PIN diode (see FIG. 2). In other words, one end of each phase control line is connected to the PIN diode and the other end is connected to the pad.

In this embodiment, RF ground is also DC ground, as will be explained below. However, RF ground does not need to be DC ground in every embodiment. If it is DC ground, it makes life easier as it is possible to use a common (single) ground terminal for all the switching devices.

The antenna element 10 includes a DC bias input 32 electrically coupled to the patch 14 such that variation of an electrical voltage level applied to the DC bias input 32 can vary the biases of the first, second, third and fourth PIN diodes to provide 1.5 bits reflection phase control for electromagnetic radiation with the first and/or second polarization.

In this embodiment, the DC bias input 32 is a single DC bias line, which can ease implementation at mm-waves.

The DC bias input 32 is operable at first, second and third voltage levels, $V_1$, $V_2$, and $V_3$ respectively. In this case $V_1$=0V, $V_2$=5V, and $V_3$=−5V, but other voltage levels can be used in other embodiments, provided they can switch the switching devices 24-30 appropriately. In one embodiment $V_1$=0V, $V_2$=1.5V, and $V_3$=−1.5V to reduce the power consumption using MACOM™ PIN diodes. One can further reduce the power consumption by selecting diodes with lower junction voltages. For example, MACOM MA4AGBLP912 AlGaAs Beam lead PIN diodes can be used, and/or MA4GP905 GaAs Beam lead PIN diodes can be used.

The basis of the operation is explained in "Reasonably Green Quantised Phase Smart Antennas using PIN Diode Switches" by GHULAM AHMAD, TIM W. C. BROWN, CRAIG I. UNDERWOOD and TIAN HONG LOH, which is annexed hereto.

The first PIN diode 24 is configured to be substantially non-conducting in response to the first and third voltage levels and conducting in response to the second voltage level. The second PIN diode 26 is configured to be substantially non-conducting in response to the first and second voltage levels and conducting in response to the third voltage level. The third PIN diode 28 is configured to be substantially non-conducting in response to the first and third voltage levels and conducting in response to the second voltage level. The fourth PIN diode 30 is configured to be substantially non-conducting in response to the first and second voltage levels and conducting in response to the third voltage level.

As explained above, the phase control lines 16-22 are electrically coupled between their respective PIN diode 24-30 and RF ground. Accordingly, the first, second, and third voltage levels need to be sufficient to overcome the appropriate junction voltages to provide the switching discussed above.

As a result of the above, for each of the first and second polarisations the antenna element 10 can be set in one of three reflection phase states by appropriate selection of the DC bias input voltage level.

The following equation may be helpful in stating how to quantize the phase in a reflectarray. The basis of the equation is explained in "Reasonably Green Smart Quantised Phase Smart Antennas using PIN Diode Switches" by Ghulam Ahmad, Tim W C Brown, Craig I Underwood and Tian Hong Loh, which is annexed hereto. This is just one possibility, there are many other possible combinations.

$$\Delta\Phi_Q = \begin{cases} 0, & -\frac{\pi}{4} \le (\Delta\Phi_C \% 2\pi) < \frac{\pi}{4} \quad \text{State 1} \\ \frac{\pi}{2}, & \frac{\pi}{4} \le (\Delta\Phi_C \% 2\pi) < \frac{3\pi}{4} \quad \text{State 2} \\ \pi, & -\frac{5\pi}{4} \le (\Delta\Phi_C \% 2\pi) < -\frac{\pi}{4} \quad \text{State 3} \end{cases}$$

where:

$\Delta\Phi_Q$ is the discrete quantized phase shift introduced by the antenna element, $\Delta\Phi_C$ is the desired continuous phase from that particular element, and % represents the modulo (remainder) operator.

When any of the DC voltage levels is applied to the unit cell 10, it is applied simultaneously to both polarization structures of the unit cell. Therefore, for each polarization the unit cell has three phase states. The phase states of one polarization can be identical to that of the other polarization as in this embodiment, but in other embodiments they can be totally different based on the design. Nevertheless, the operation would remain on the same principle.

Furthermore, both polarisation beams can point on the same angle (coverage area), which is normally the case in satellite operation where one beam is for transmit and other is for receive while operating at the same or different frequencies.

In this embodiment, the DC bias input 32 is offset from a centre of the patch 14 by Δy in the first polarization direction and by Δx in the second polarization direction in order to balance the unit cell electrically for current distribution over the unit cell structure to reduce cross-polarisation. The co-polar and cross polar far fields are related to the surface current distribution of the antenna. By controlling the surface currents it is possible to control the far field.

In other words, when the DC bias line 32 is offset from the centre by a certain amount it results in a current distribution which reduces the cross polarized fields in the antenna far field by reducing the excitation of modes responsible for cross polarization.

The amount of offset is determined by the lines 16-22 of the phase control line lengths and diode parameters and can be determined by the skilled person.

Figure 3:
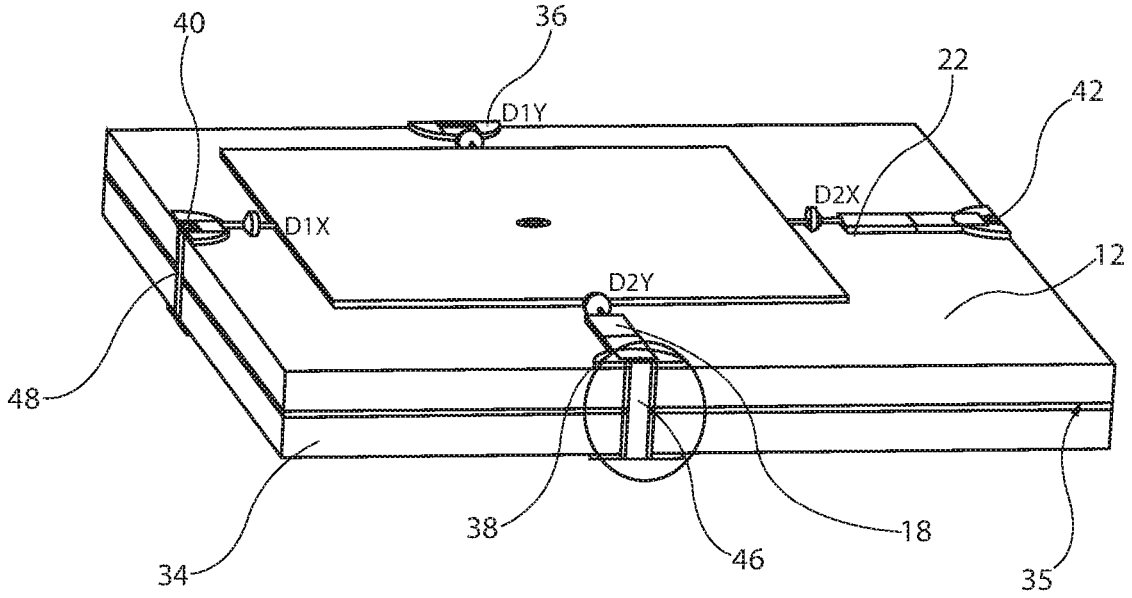
FIG. 3 is a perspective view of the reflectarray antenna element of FIGS. 1 and 2.
Figure 4:
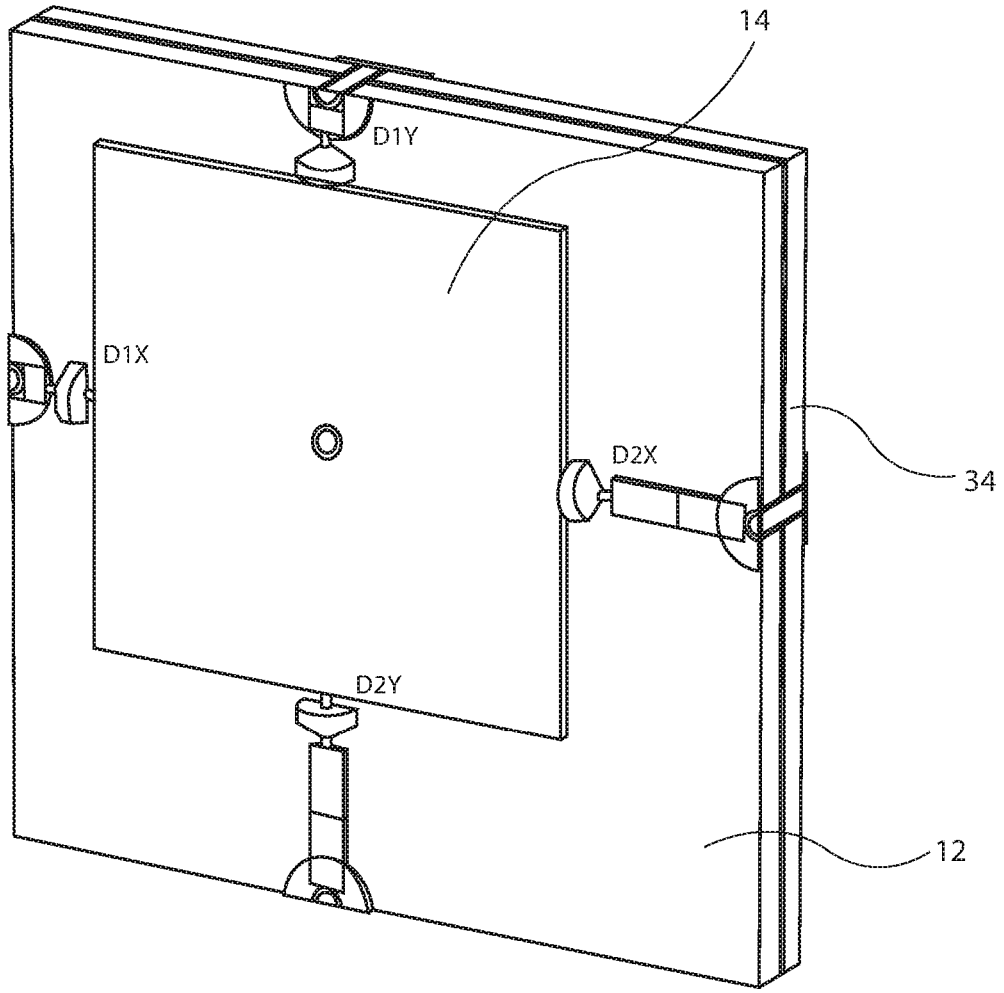
FIG. 4 is a perspective view of the reflectarray antenna element of FIGS. 1 to 3.

In this embodiment, the antenna element 10 is a three layer substrate structure. This can be seen most clearly in FIG. 3.

The antenna element 10 includes a second substrate 34 which can be the same as the first substrate 12 or can be different. In this embodiment, the second substrate is a bond-ply (RO 2929) layer. The second substrate 34 can in some other embodiments be used also to provide rigidity to the unit cell as well as to print isolation stub on the third layer as discussed below. The second substrate 32 can be thicker than the first substrate 12.

The three layers include a first or top layer on a first side of the first substrate, a second layer on the second or bottom side of the first substrate, effectively sandwiched between the first and second substrates and adjacent to a first side of the second substrate, and a third or bottom layer on a second side of the second substrate. The first substrate can be considered a double sided PCB.

The patch 14, PIN diodes 24-30, phase control lines 16-22, and pads 36, 38, 40, 42 from the unit cell 10 and are provided at the first layer. In this way, the antenna element is configured to implement 1.5 bits phase control for electromagnetic radiation with the first polarisation, and/or for electromagnetic radiation with the second polarisation, directly at the first layer or RF plane of the antenna element using a single DC bias line.

The second or middle layer is in this embodiment a ground layer 35 to provide the stable voltage levels and in this embodiment is a layer of copper provided on the second side of the first substrate and connected to ground potential which in this example is 0V. In other embodiments, other conductive materials can be used for the ground layer.

As discussed above, each phase control line 16, 18, 20, 22 has its respective pad 36, 38, 40, 42 at the end of the respective phase control line which is opposite to the end at which it is coupled to its respective PIN diode. In other words, one end of each phase control line is connected to the PIN diode and the other end is connected to the pad. In this embodiment, each pad is electrically conductive and provides an electrical connection to the ground layer via a respective through hole via 44, 46, 48, 50 which passes through the first substrate and links the first and second layers. The via holes 44, 46, 48, 50 electrically connect their respective pads to the ground layer 35, for example by being plated through-holes.

In this embodiment, although not necessary in every embodiment, the via holes 44, 46, 48, 50 also pass through the second substrate, thereby linking the first, second, and third layers. The via holes 44, 46, 48, 50 are each electrically coupled to a respective pad in the third layer which thereby provide electrical connections to ground at the third layer. This provides advantages in that it avoids providing blind vias which are hard to fabricate, as well as expensive and not reliable. By passing through both first and second substrates, fabrication is reliable. The vias also mean that ground is available on the third or bottom layer. The availability of ground on the third or bottom layer facilitates the DC return path. Similarly, having the vias terminate at the third or bottom layer enables fabrication fault finding at later stages.

In this embodiment, the vias 44, 46, 48, 50 are castellated holes. These can be shared among the neighbouring similar unit cells therefore only a half portion (and half pad) is shown in the Figures. They will get other half from the neighbouring unit cell when placed in the reflectarray. This is done to reduce inter-unit cell distance to achieve grating free main lobe scanning in the final reflectarray. In this way, fewer holes are required in total. Additionally, due to better inter-unit cell spacing, wide angle scanning is possible.

The DC bias input includes a DC via 52 (FIG. 6) which links the first and third layers without electrical connection to the ground layer. The DC via 52 passes through the first and second substrates and the ground layer and electrically connects the patch 14 to a DC bias pad 54 in the third layer, for example by being a plated through hole. The ground layer is electrically insulated from the DC via 52 where it passes through the ground layer to avoid electrical connection of the DC via 52 to the ground layer, in this embodiment by having a hole 56 providing spacing around the DC via 52. In other embodiments, an electrically insulating material can be disposed between the DC via 52 and the ground layer.

Figure 5:
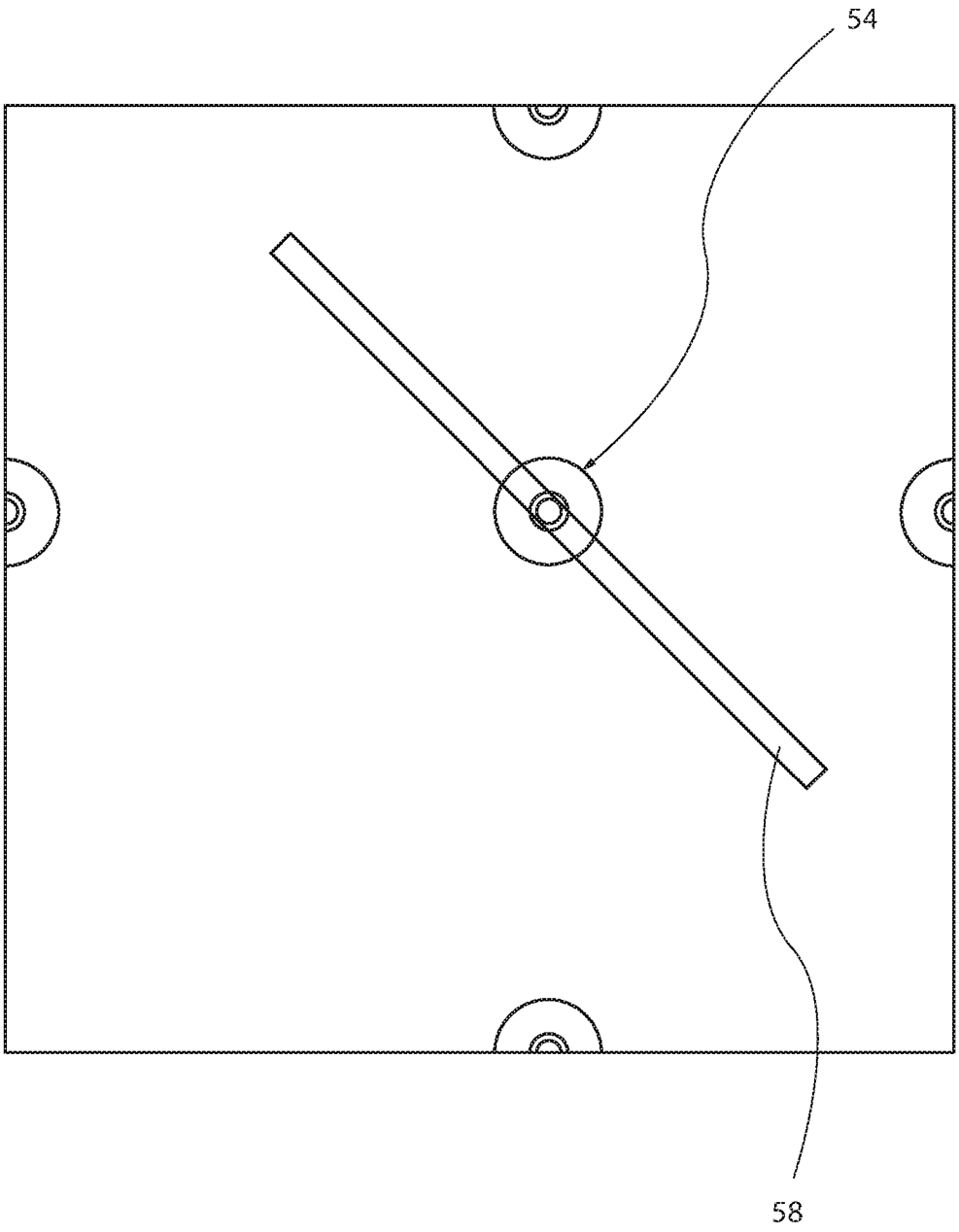
FIG. 5 is a bottom view of the reflectarray antenna element of FIGS. 1 to 4.
Figure 6:
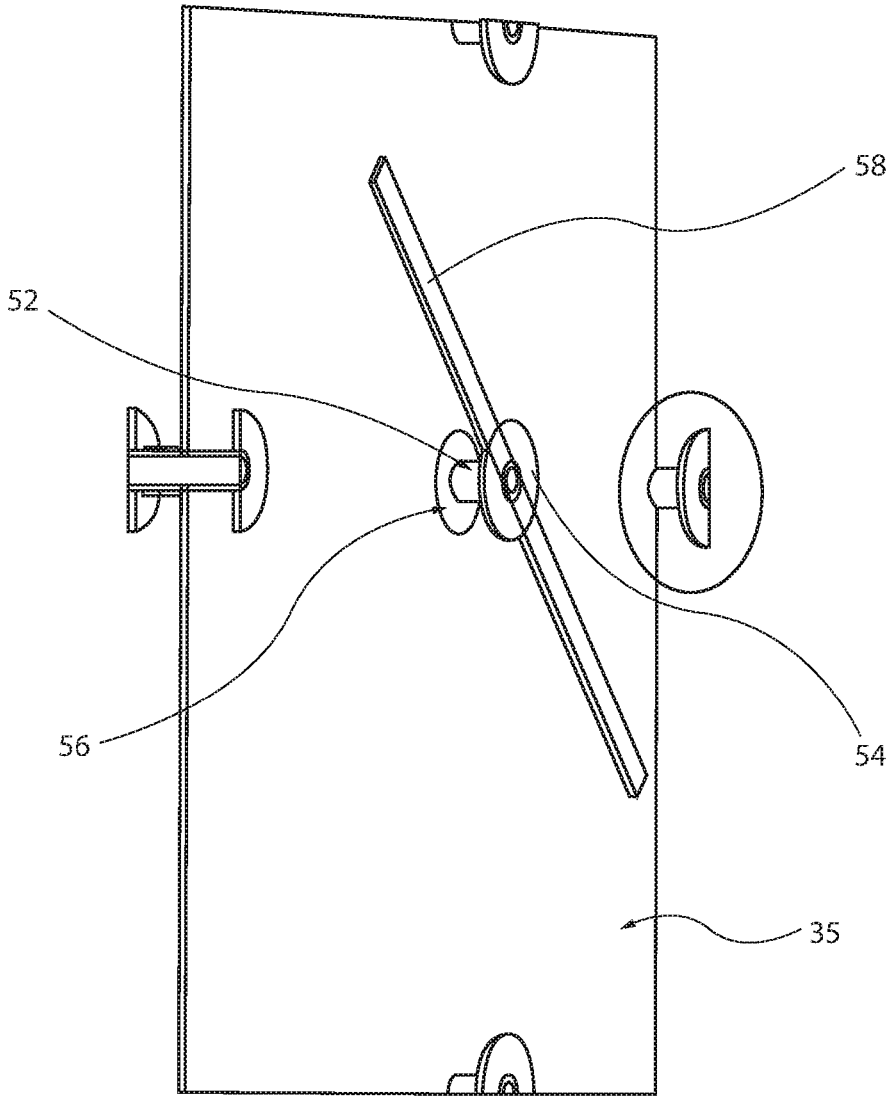
FIG. 6 is a perspective view from the bottom of the reflectarray antenna element of FIGS. 1 to 5 with the substrates removed.
Figure 7:
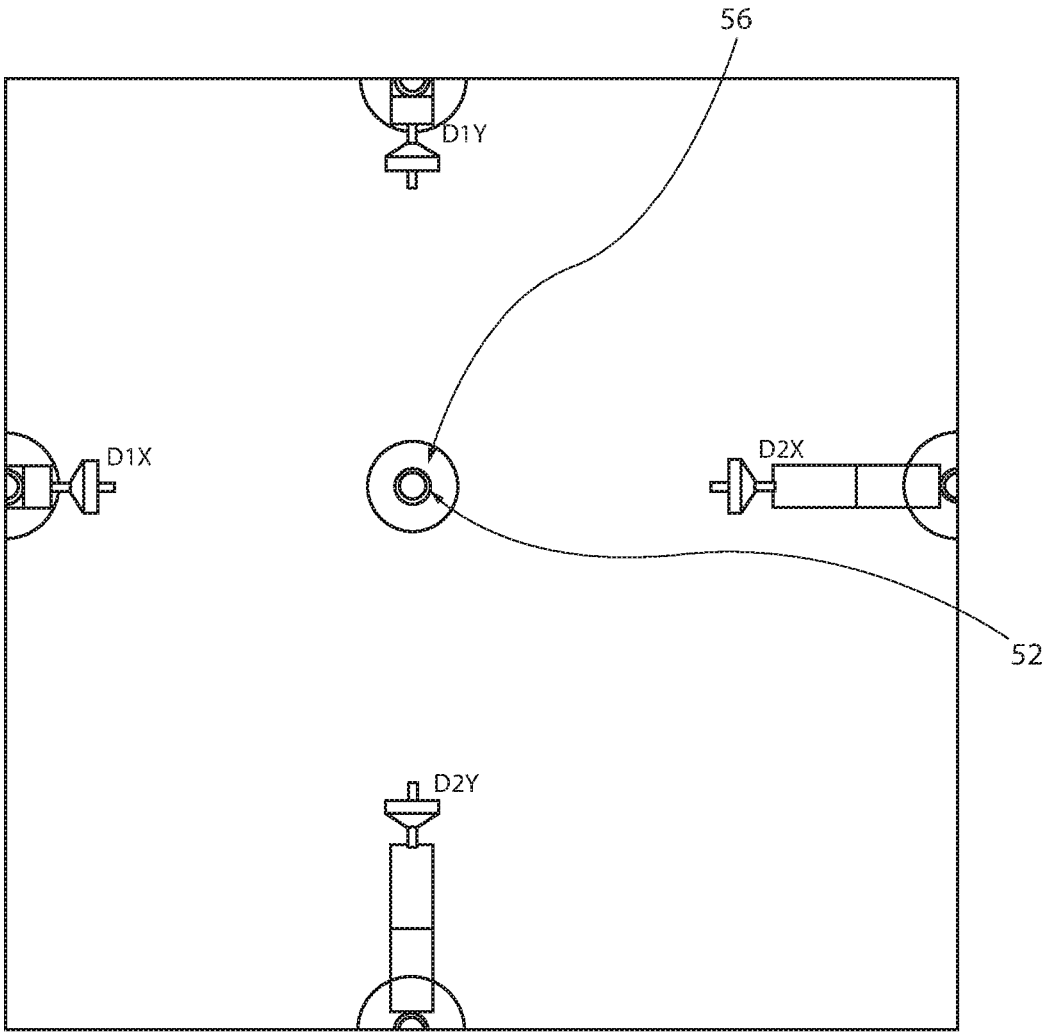
FIG. 7 is a top view of the reflectarray antenna element of FIGS. 1 to 6 with the patch and substrates removed.

As can be seen in FIGS. 5 and 6, the DC bias input is electrically coupled to a DC isolation element 58 at the third layer to isolate the DC from RF signals. In this embodiment, the DC isolation element is a DC isolation stub 58 which extends laterally from the DC bias pad 54. As can be seen, the DC isolation stub 58 is elongate and extends in two diametrically opposite directions from the DC bias pad 54, although other arrangements are possible in other embodiments.

In this embodiment, the pads are all copper. However, other electrically conductive materials can be used in other embodiments.

In the description above, where elements are described as being electrically connected or coupled and no other components are described as being coupled between them, then they are preferably directly connected or connected with no significant electrical components between them.

The operation of the antenna element is described below.

Operation: Vertical Polarization

Figure 8:
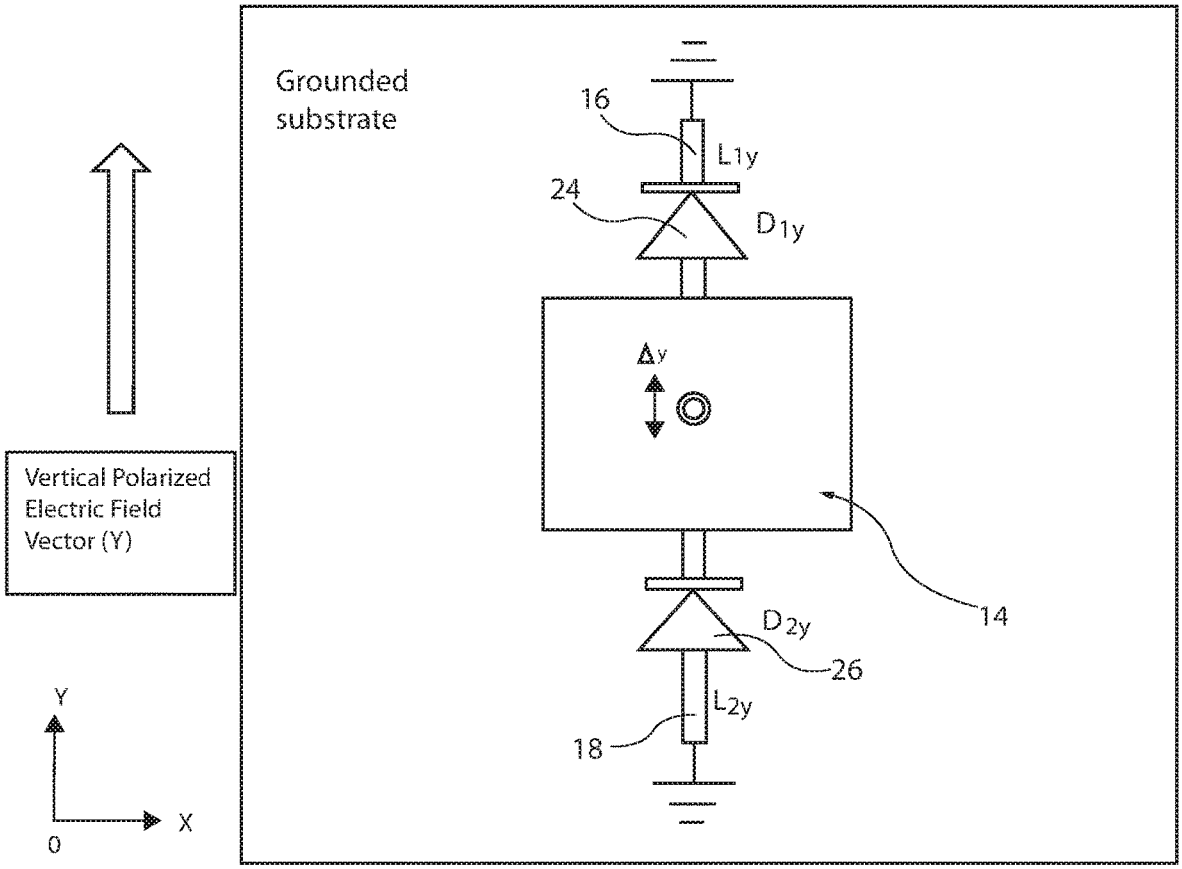
FIG. 8 is a top view of the reflectarray antenna element of FIGS. 1 to 7 with only the portion of the unit cell which is responsible for vertical polarisation shown.

In FIG. 8, only the portion of unit cell which is responsible for vertical polarization is shown. The rest of the structure is not shown for the sake of clarity. Similarly, for an OFF state PIN diode, the equivalent OFF state circuit is not shown connected to the patch for simplicity, although it shall be present in practice.

With vertical polarization the unit cell has three states. These states are selected by the DC bias voltages. At a given time, one of the DC voltage levels (out of the given three voltage levels) will be applied to unit cell and the corresponding state would be selected.

In this described embodiment, the DC bias voltages are configured as follows:

| Voltage | $D3 = D_{1X}$ | $D4 = D_{2X}$ |
|---|---|---|
| 1.5 V | ON | OFF |
| 0 V | OFF | OFF |
| −1.5 V | OFF | ON |
| **Voltage** | **$D1 = D_{1Y}$** | **$D2 = D_{2Y}$** |
| 1.5 V | ON | OFF |
| 0 V | OFF | OFF |
| −1.5 V | OFF | ON |

Vertical Polarization: State 1

As shown in FIG. 9, when the DC bias input is at the first voltage level, in this case DC=0V, both the first and second diodes 24 and 26 are not powered up (zero bias of diodes, they are in OFF state). As a result, patch 14 is left as itself without these diodes (in an electrical sense). As stated above the OFF state equivalent circuits are not shown/included here although they shall be present in practice.

Frequency of operation is decided by the first length 60. This can be referred to as Frequency 1 in Y polarization: $FREQ_{1Y}$.

Corresponding to this frequency, there is a reflection phase from the unit cell: $PHASE_{1Y}$ when observed at the design frequency F1.

Therefore, DC=0V, →$FREQ_{1Y}$→$PHASE_{1Y}$: Call this as State 1 in Y Polarization→$STATE_{1Y}$.

Vertical Polarization: State 2

Figure 10:
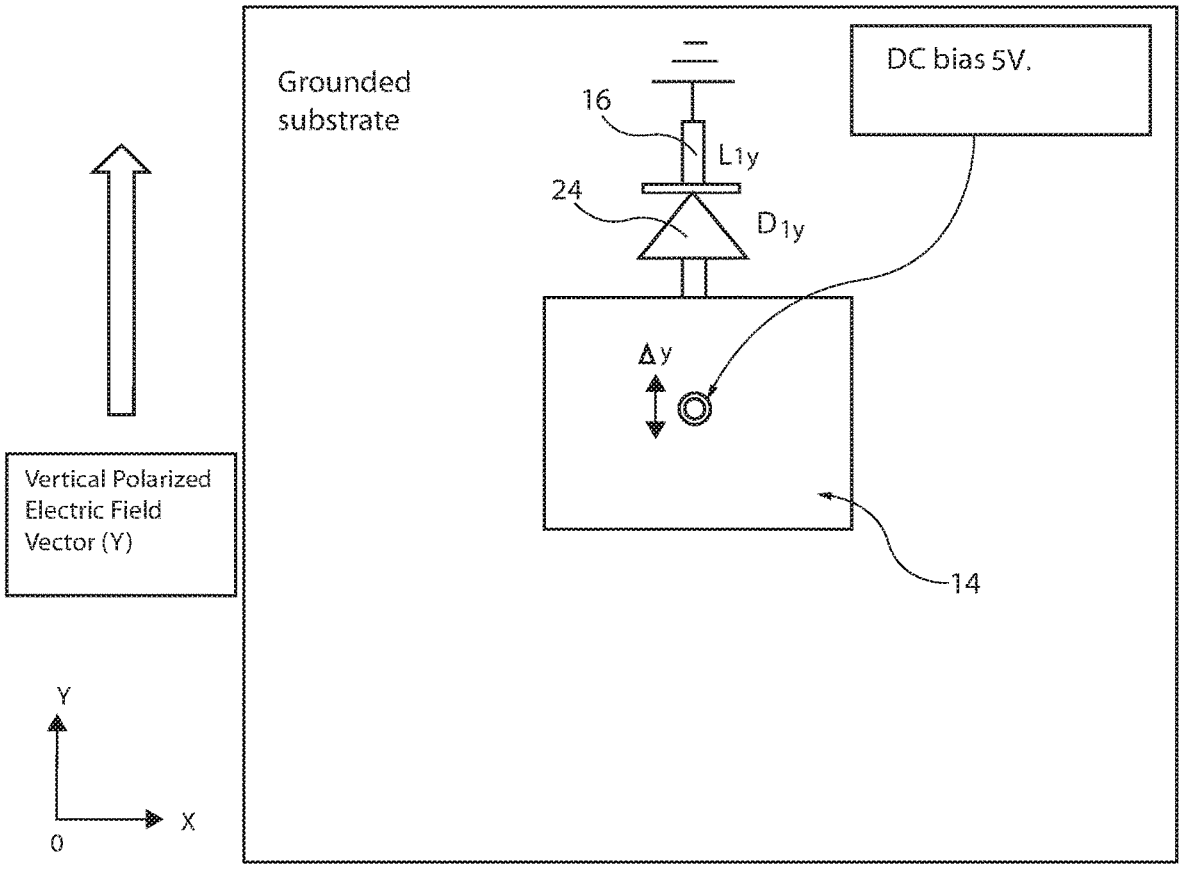

As shown in FIG. 10, when the DC bias input is at the second voltage level, in this case DC=5V or 1.5V, the first diode 24 is forward biased and the second diode 26 is reverse biased. The first diode 24 acts as a closed (ON) switch and electrically connects the first stub 16 with the patch 14. The second diode 26 electrically disconnects the second phase control line length from the patch 14.

As a result, there is a new structure which has a new frequency of operation.

This is referred to as Frequency 2 in Y polarization: $FREQ_{2Y}$.

Corresponding to this frequency there is a reflection phase from the unit cell: $PHASE_{2Y}$.

Therefore, DC=5V, →$FREQ_{2Y}$→$PHASE_{2Y}$: Call this State 2 in Y Polarization→$STATE_{2Y}$ Vertical Polarization: State 3

Figure 11:
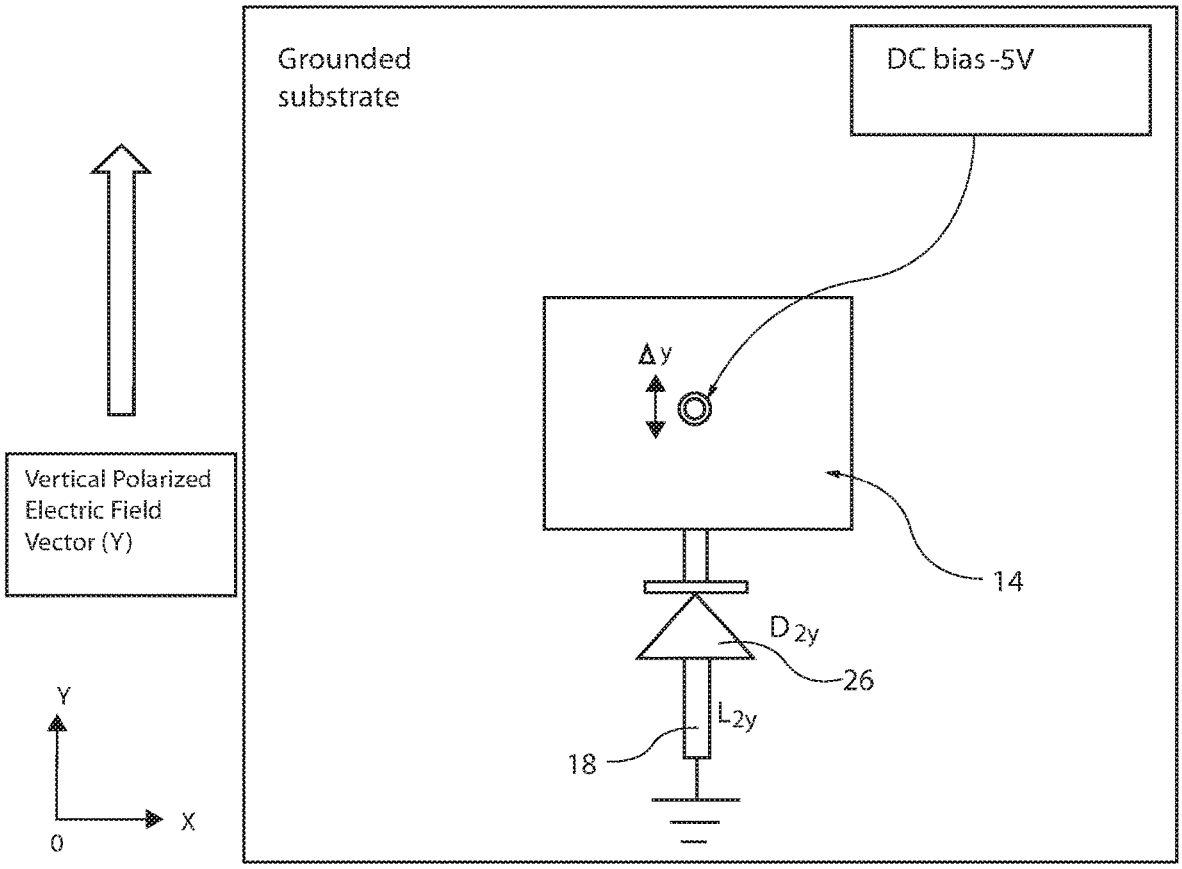

As shown in FIG. 11, when the DC bias input is at the third voltage level, in this case when DC=−5V or −1.5V, the second diode 26 is forward biased and the first diode 24 is reverse biased. The second diode 26 acts as a closed (ON) switch and electrically connects the second stub 18 with the patch 14. The first diode 24 electrically disconnects the first stub from the patch 14.

As a result, there is again a new structure which is different from the previous two cases due to its design. As a results this third structure has a new frequency of operation.

This is referred to as Frequency 3 in Y polarization: $FREQ_{3Y}$.

Corresponding to this frequency there is a reflection phase from the unit cell: $PHASE_{3Y}$.

Therefore, DC=−5V, →$FREQ_{3Y}$→$PHASE_{3Y}$: Call this State 3 in Y Polarization→$STATE_{3Y}$.

When the patch 14 and stub lengths $L_{1Y}$ and $L_{2Y}$ are engineered appropriately, it is possible to generate any three phases in the range of 0 to 360 degrees for Y polarization as discussed above. When the first patch length 60 is decided, it determines the frequency of operation in Y polarization. It also makes one of the phase states fixed. The other two phase states are engineered around this to get desired phase differences with respect to this fixed state. The unit cell design only consumes DC power in two of its phase states, while one state does not consume DC power and saves DC power.

Figure 12:
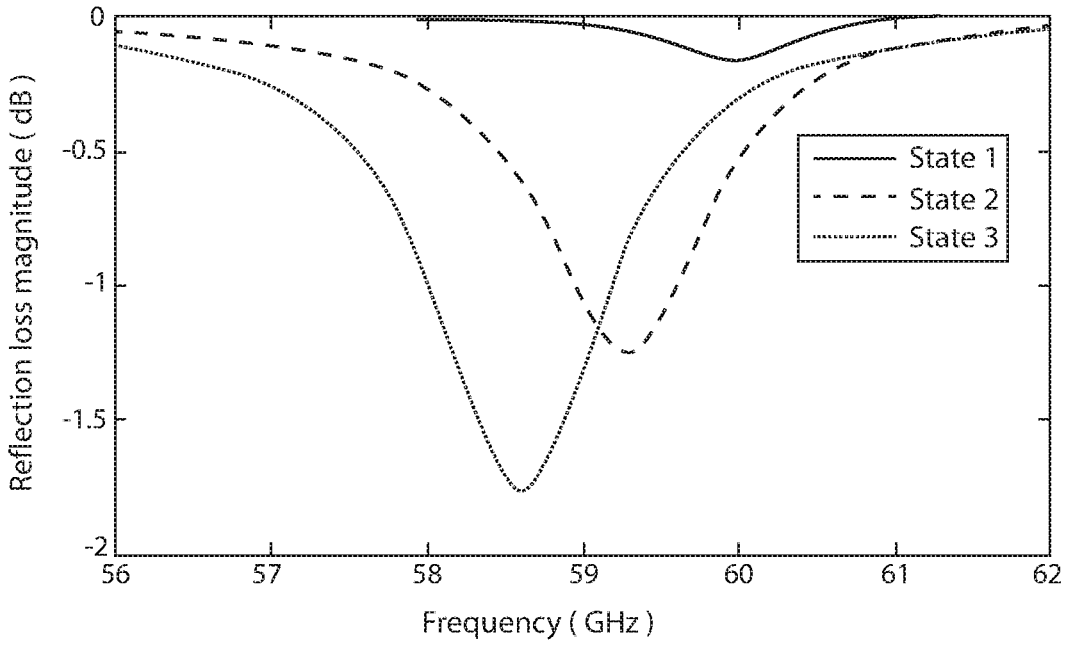
FIG. 12 is a graph of reflection loss magnitude against frequency for a Y polarised field.

In FIG. 12 it can be seen that three different resonant frequencies can be generated from the three structures made possible through switching of the diodes. The reflection loss indicates the loss in the electromagnetic field strength when reflected back from the unit cell in different states. The loss shown in the graph represents the losses in the unit cell and is optimal as compared to devices in the art.

Figure 13:
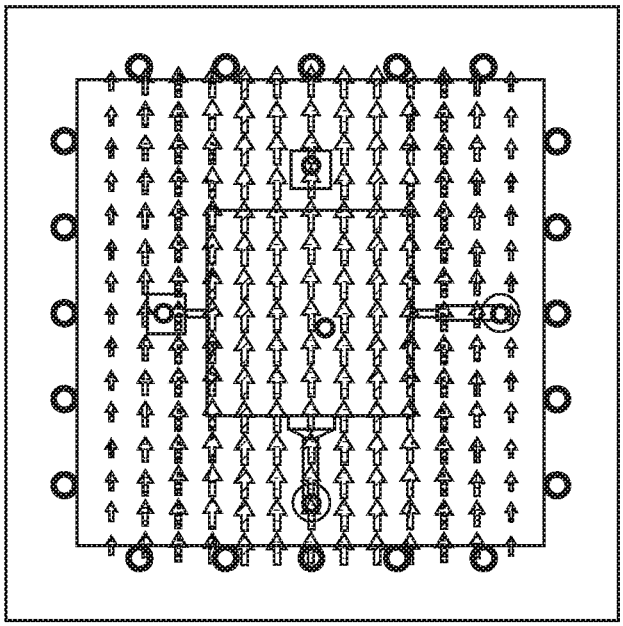
FIG. 13 shows a Y polarised field incident on a complete unit cell.

In FIG. 13 a Y polarized field incident on the complete unit cell is shown by the arrows. This unit cell was fabricated as shown in the drawing and is a little different from the unit cell disclosed above, in that the two pads are square/rectangular instead of being circular. The pads can have various shapes in different embodiments. However, FIG. 13 shows the operation, which is identical. The arrow colours indicate the strength of this field, being maximum at the centre.

Figure 14:
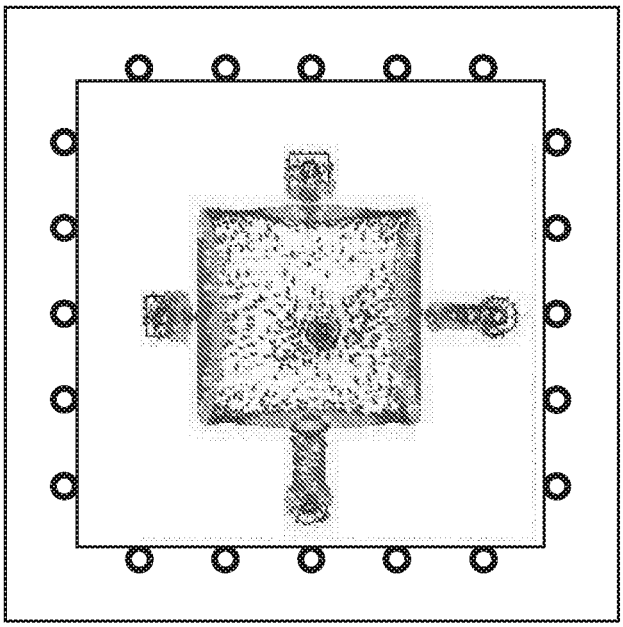
FIG. 14 shows the resulting current distribution.

FIG. 14 shows the resulting current distribution on the surface of the unit cell. Red indicates maximum, and blue indicates a minimum. This current distribution is in one of the sates $STATE_{3Y}$. The other two states would have their own, similar distributions.

FIGS. 13 and 14 show the complete unit cell along with the X polarized parts too. However, the current distribution in FIG. 14 indicates that major contribution is by the Y part of the unit cell for Y polarization.

Operation: Horizontal Polarization

Figure 15:
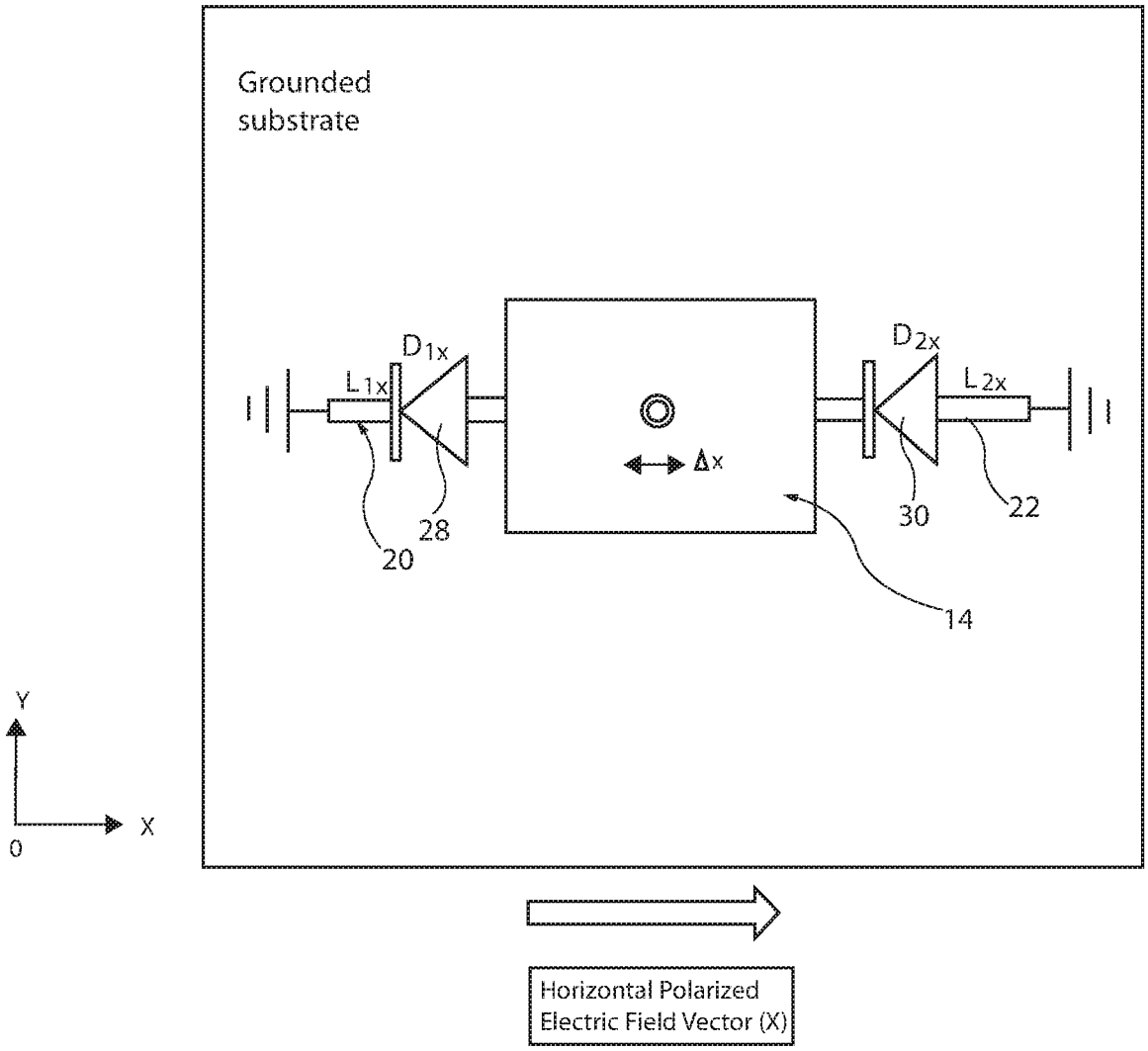
FIG. 15 is a top view of the reflectarray antenna element of FIGS. 1 to 11 with only a portion of the unit cell which is responsible for horizontal polarisation shown.

In FIG. 15, only the portion of unit cell which is responsible for horizontal polarization is shown. The rest of the structure is not shown for the purpose of clarity.

With horizontal polarization the unit cell has three states. These states are selected by the DC bias voltages. At a given time one of the DC voltage levels (out of the given three voltage levels) will be applied to the unit the cell and the corresponding state would be generated.

Horizontal Polarization: State 1

As shown in FIG. 16, when the DC bias input is at the first voltage level, in this case DC=0V, both the third and fourth diodes 28 and 30 are not powered up (zero bias of diodes, they are in OFF state). As a result, patch 14 is left as itself without these diodes (in an electrical sense). As stated above the OFF state equivalent circuits are not shown here for clarity, although they shall be present in practice.

Frequency of operation is decided by the second length 62. This can be referred to as Frequency 1 in X polarization: $FREQ_{1X}$.

Corresponding to this frequency there is a reflection phase from the unit cell when observed at the design frequency for this polarization: We call it $PHASE_{1X}$ Therefore, DC=0V, →$FREQ_{1X}$→$PHASE_{1X}$: Call this State 1 in X Polarization→$STATE_{1X}$.

Vertical Polarization: State 2

Figure 17:
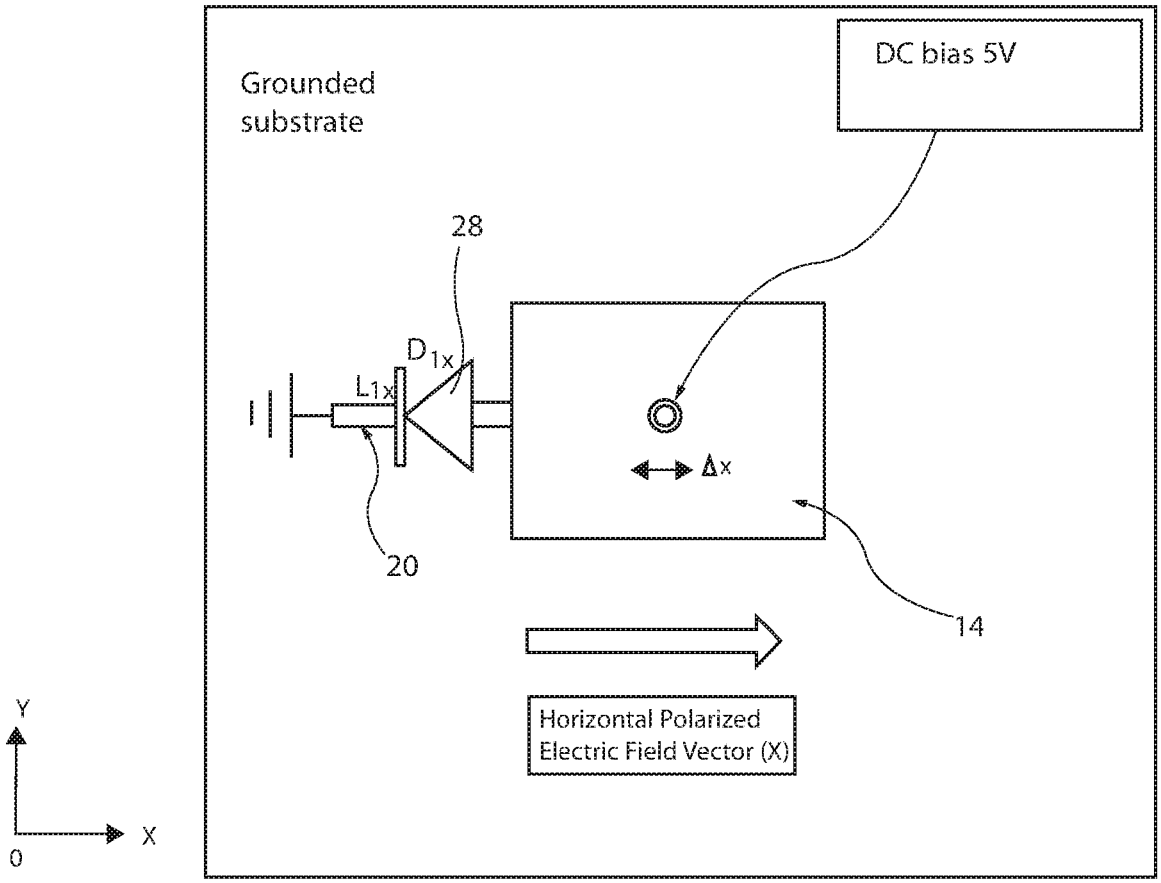

As shown in FIG. 17, when the DC bias input is at the second voltage level, in this case DC=5V or 1.5V, the third diode 28 is forward biased and the fourth diode 30 is reverse biased. The third diode 28 acts as a closed (ON) switch and connects the third stub 20 with the patch 14. The fourth diode 30 electrically disconnects the fourth stub from the patch 14.

As a result, there is a new structure which has a new frequency of operation.

This is referred to as Frequency 2 in X polarization: $FREQ_{2X}$.

Corresponding to this frequency there is a reflection phase from the unit cell: $PHASE_{2X}$.

Therefore, DC=5V, →$FREQ_{2X}$→$PHASE_{2X}$: Call this State 2 in X Polarization→$STATE_{2X}$.

Vertical Polarization: State 3

Figure 18:
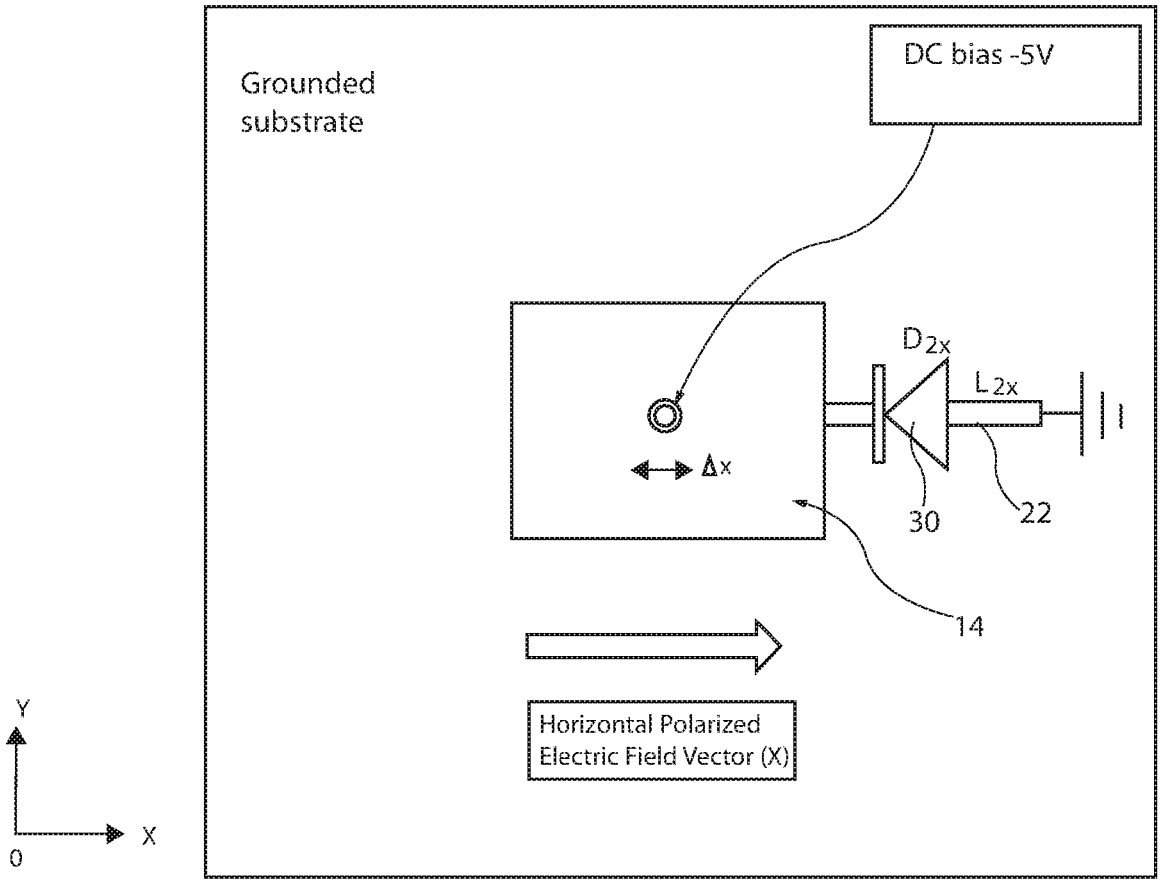

As shown in FIG. 18, when the DC bias input is at the third voltage level, in this case DC=−5V or −1.5V, the fourth diode 30 is forward biased and the third diode 28 is reverse biased. The fourth diode 30 acts as a closed (ON) switch and connects the fourth stub 22 with the patch 14. The third diode 28 electrically disconnects the third stub from the patch 14.

As a result, there is again a new structure which is different than the previous two cases due to its design. As a results this third structure has a new frequency of operation.

This is referred to as Frequency 3 in X polarization: $FREQ_{3X}$.

Corresponding to this frequency there is a reflection phase from the unit cell: $PHASE_{3X}$.

Therefore, DC=−5V, →$FREQ_{3X}$→$PHASE_{3x}$: Call this as State 3 in X Polarization→$STATE_{3X}$.

When the Patch 14, and stub lengths $L_{1X}$ and $L_{2X}$ are engineered appropriately, it is possible to generate any three phases in the range of 0 to 360 degrees for X polarization at the design frequency as discussed above. When the second patch length 62 is decided, it determines the frequency of operation in X polarization. It also make one the phase states fixed. Then the other two phase states are engineered around this to get desired phase differences with respect to this fixed state.

Figure 19:
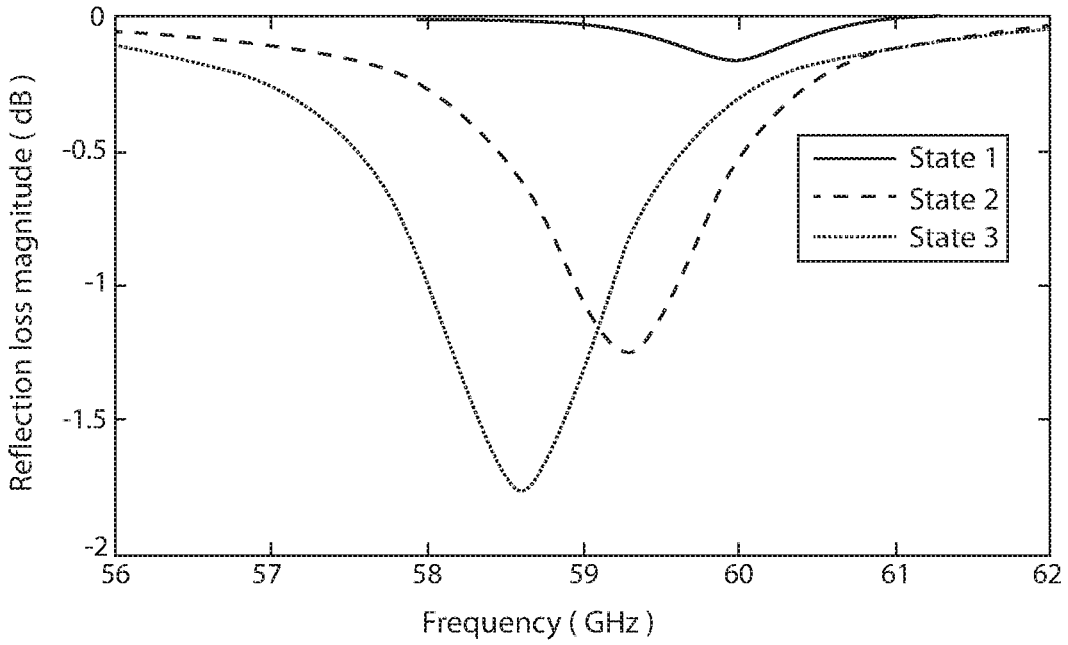
FIG. 19 is a graph of reflection loss magnitude against frequency for a X polarised field.

In FIG. 19 it can be seen that three different resonant frequencies are there due to the three structures made possible through switching of the diodes. The reflection loss indicates the loss in the EM field strength when reflected back from the unit cell in its different states. The loss shown represents the losses in the unit cell and is optimal as compared to the art.

Figure 20:
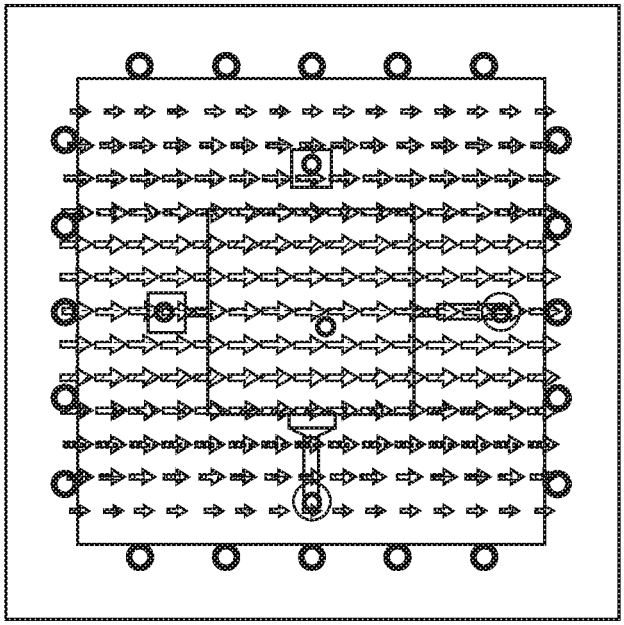
FIG. 20 shows a X polarised field incident on a complete unit cell.

In FIG. 20 an X polarized field incident on the complete unit cell is shown by the arrows. This unit cell shown in this Figure is a little different from the unit cell disclosed above in connection with FIG. 13, however the operation is identical. The arrows indicate the strength of this field, being maximum in the centre.

Figure 21:
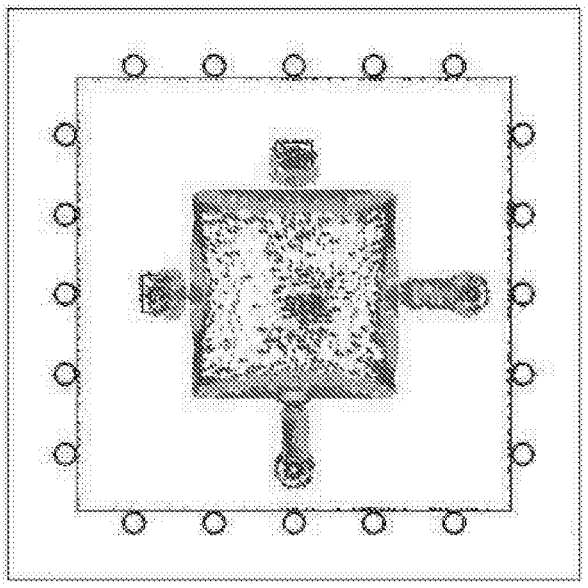
FIG. 21 shows the resulting current distribution.

FIG. 21 shows the resulting current distribution on the surface of the unit cell. Red indicates maximum and blue indicates a minimum. This current distribution is in one of the sates $STATE_{3X}$. The other two states would have their own, similar, distributions.

FIGS. 20 and 21 show the complete unit cell along with the Y polarized parts also. However, the current distribution in FIG. 21 indicates that major contribution is in the X part of the unit cell for X polarization.

Function of ΔY and ΔX Variables:

Cross Polarization Behaviour/Polarization Purity of Unit Cells

Figure 22:
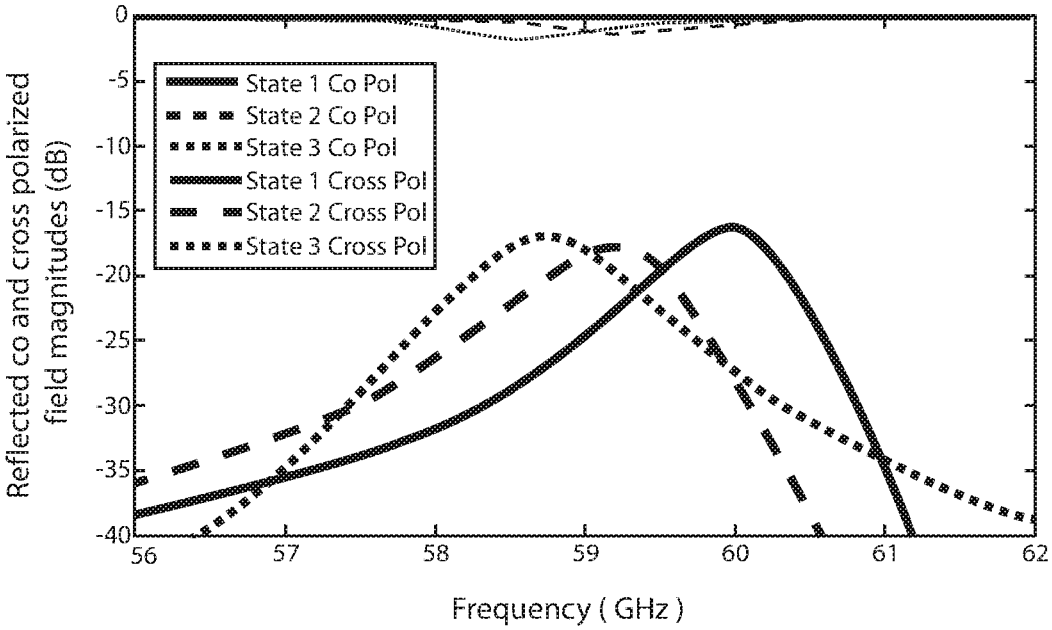
FIG. 22 is a graph of reflected co and cross polarised field magnitudes against frequency.
Figure 23:
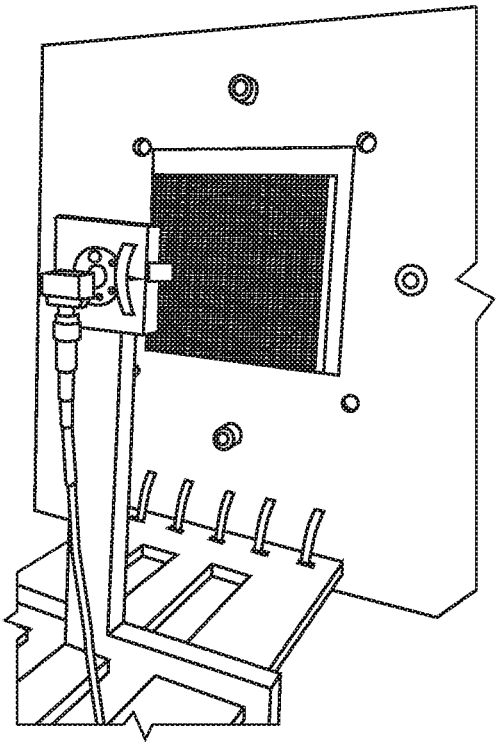
FIGS. 23 and 24 show phase quantized non-reconfigurable reflectarray demonstrators which are passively configured to point the main beam at various pointing angles.
Figure 24:
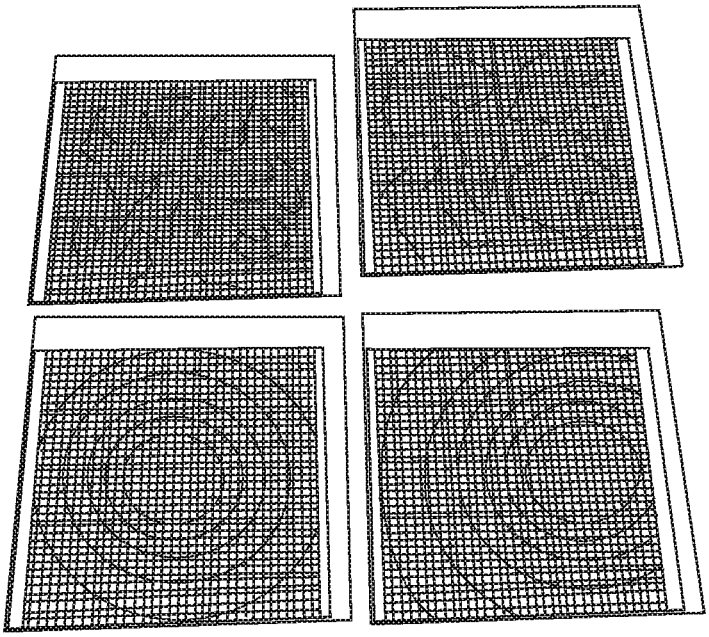

When the physical structure is changed by switching of the different diodes, the polarization purity is lost for a particular polarization. Therefore the unit cell includes a mechanism to achieve good polarization purity in the form of two variables termed herein ΔY and ΔX. The mechanism controls the surface current distribution of the structure by offsetting the DC bias via from the centre as disclosed above. How much it should be offset from centre, is subject to the required phase states and can be determined by the skilled person. After the optimization, results as shown in FIG. 22 were achieved for the states described above.

"Co Pol" represents the reflection of the field with desired polarization. Cross polarization (Cross Pol) is the reflection of the field of undesired polarization, which is orthogonal to the desired polarization. For example, if the incident field is X polarized then in this design one can expect the reflected field to be X polarized (same polarization). However, due to multiple states it is not perfectly possible. Therefore, some magnitude of orthogonal polarization (Y Pol in this example) would be reflected for an incident X polarization. By offsetting the DC bias point one can suppress the undesired modes which generate the cross polarized field. The suppression of these modes improves the polarization purity of a unit cell which has been achieved in embodiments of this invention through offsetting the DC bias point.

To further improve the polarization purity, the proposed unit cell is also compatible to be implemented in the reflectarray using cross polarization techniques known in the art and described by common general knowledge in literature, such as global mirror symmetry in four quadrants or local mirror symmetry over a reduced number of elements (minimum 4). The orientation of each unit cell allows this functionality. This allows for adapting to reduce cross polarization even further for a particular application.

Using a plurality of reflectarray antenna elements as described, a reflectarray can be provided. In the preferred embodiment, the plurality of antenna elements are disposed adjacent to each other such that the castellated via holes of adjacent antenna elements are adjacent to each other, enabling the adjacent antenna elements to share the via holes as disclosed above.

Each of the reflectarray antenna elements in the reflectarray can be configured to provide different reflection phase states and therefore different phase shifts. The phase shifts provided can be selected based on the location of the element within the reflectarray and the main beam radiation direction of the reflectarray antenna.

The reflectarray may include a control system configured to control the voltage levels of the DC bias input of each of the antenna elements. In some embodiments, the control system may control the reflectarray to provide one or more and optionally all of a single pencil beam, multiple pencil beams, contoured beam, and scanning beams. In some embodiments, the reflectarray may provide a platform to implement sidelobe control techniques based on phase synthesis. In some embodiments, the reflectarray is suitable for multiple antenna configurations, including single centre fed or offset fed case, dual Cassegrain or Gregorian, or Ring focus antennae. In some embodiments, the reflectarray is capable of continuous beam scan or switched beams, adaptive beam forming or switched beamforming.

Advantages include that when the number of devices in the design at mm-wave is increased complexity becomes very high. This includes the reduced physical space for inclusion of devices, DC biasing of devices, and the required RF performance. Embodiments of the present invention enable the antenna to be compact and can meet the desired performance criteria using a relatively small physical aperture of the antenna array.

Features and advantages of the embodiments of the invention include the following:

- States 1, 2, 3 for both first and second polarisations can be controlled individually on a single patch
- 1.5 bits implementation (three phase states) using two diodes per polarization (total of four diodes for dual polarization) while still maintain a single DC line
- Reflectarray consisting of a feeding source and a smart reflecting surface
- Smart reflecting surface consisting of unit cells as detailed above
- Each unit cell provides three phase states to implement a 1.5 bits reflection phase control
- Less number of via holes required, with hole sharing topology used in the preferred design
- Only one DC bias line is used to control two linear orthogonal polarizations at two identical or different frequencies in each unit cell A single DC bias line is exploited to improve polarization purity in unit cells
Simultaneously controls two orthogonally polarized antenna beams
Both orthogonally polarized antenna beams can have same or different frequencies
Low loss smart reflection surface due to low loss in unit cells
Design capable for extension to reflectarrays of any size
Implementation of implicit phase shifters at direct RF plane of antenna
Eliminates separate phase shifters normally required for beamforming
Low complexity to favour large designs for very high gain
Simple control implementation
Wide angle beam scanning: +/−78 degrees in Theta at any Phi (0 to 360 degree)
Discrete/Quantized reflection phase control
Performance is only 1.6 dB down is compared to a continuous phase control system
DC biasing complexity at RF level not increased as compared to a single bit implementation
Provides a platform to implement any phase synthesis technique for radiation pattern control including single pencil beam, multiple pencil beams, contoured beam, and scanning beams thereof
Platform to implement sidelobe control techniques based on phase synthesis
Suitable for multiple antenna configurations including single centre fed or offset fed case, dual Cassegrain or Gregorian, or Ring focus antennae
Planar profile/low profile, and can be made conformal
Enables very high gains and wide angle beam scanning capabilities simultaneously
Capable for continuous beam scan or switched beams=adaptive beam forming or switched beamforming
Low DC power consumption solution with high gain, wide angle scanning smart antennas
An alternate to mm-wave beamforming: It does the same job as achieved by a beam former however implementation is completely different
Possible applications in 5G backhauls, Inter-satellite links, 5G receive and transmit antennas, military antennas, space applications, automotive radars, high data rate wireless communications systems (outdoor cellular systems), imaging systems, quasi-optical power combiners etc.
Design capable to be scaled to any frequency range provided PIN diodes are available at that frequency
Reliable design due to PIN diodes being very reliable
Low RF losses
Low power
Lightweight
High data transfer rates
Low cost
Enables futuristic (as yet to be defined) applications Further details, explanation, and options may be found by reference to "An investigation of millimetre wave reflectarrays for small satellite platforms" by Ahmad et al, Acta Astronautica, Volume 151, October 2018, Pages 475-486, available at https://www.sciencedirect.com/science/article/pii/S0094576518308622, the disclosure of which is incorporated herein by reference in its entirety.

Modifications

Although in the embodiments described above, ±5V and 0V is used, advantageous embodiments can use PIN diodes operated at 5 mA current and/or +, −1.5V DC to achieve low power consumption in comparison to diodes operated at higher currents or voltages. The power consumption can be further reduced if the diodes are selected with a low junction voltage value. In one example it can be around 1.35 V; although it can be as low as 0.8 V.

Figure 25:
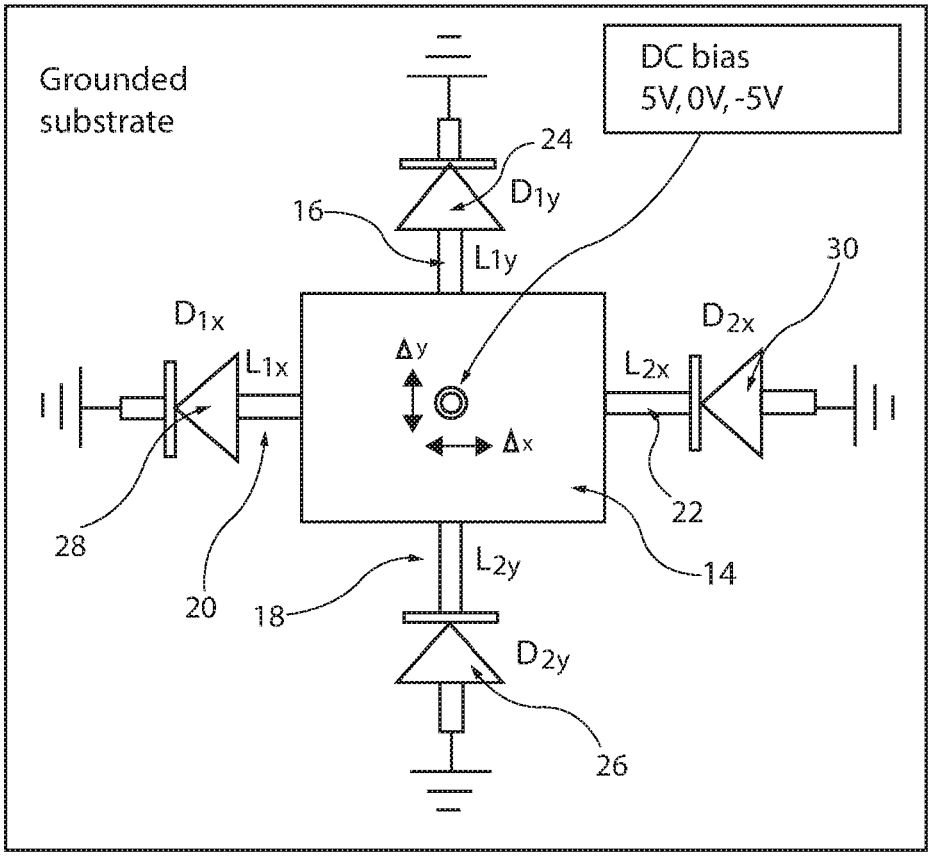
FIG. 25 shows a circuit diagram of a reflectarray antenna element according to an embodiment of the invention.
Figure 26:
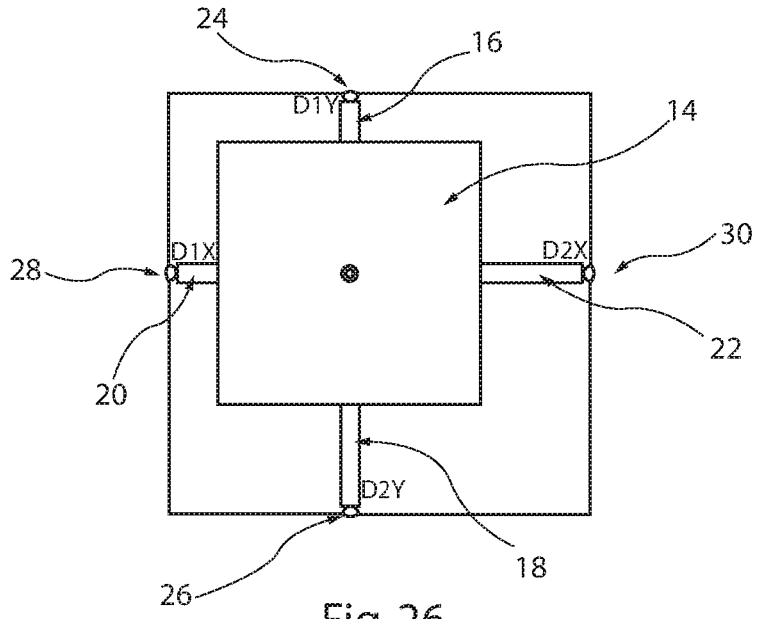
FIGS. 26 to 31 show an embodiment of the invention.
Figure 27:
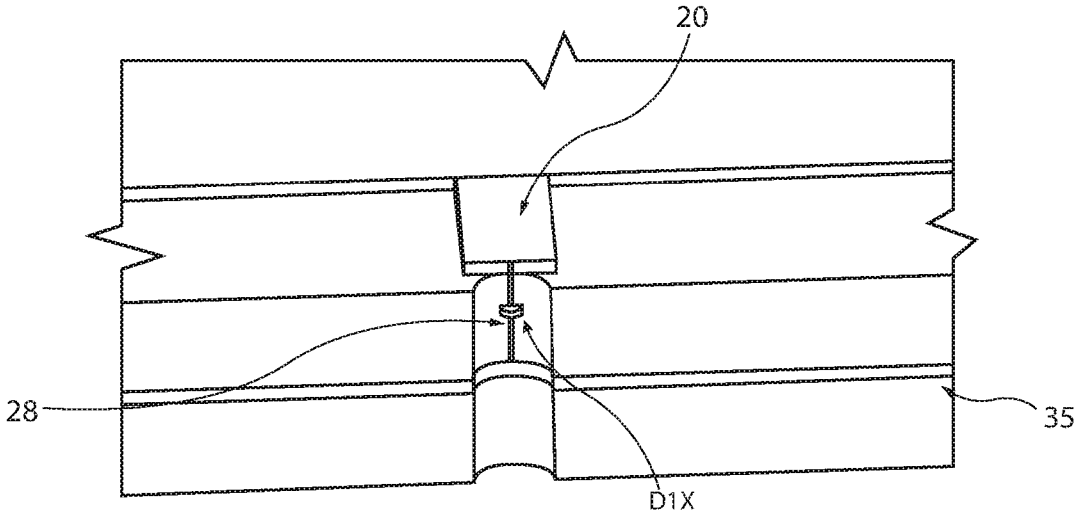
Figure 28:
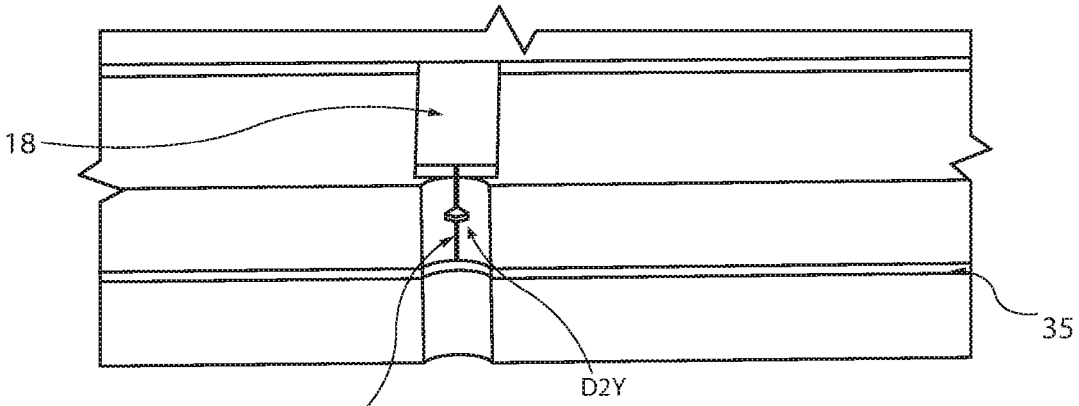
Figure 29:
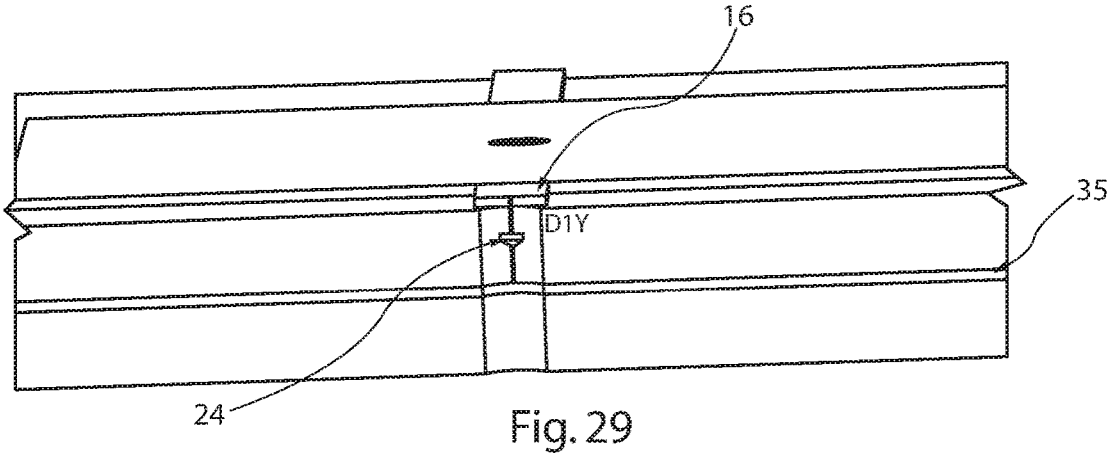
Figure 30:
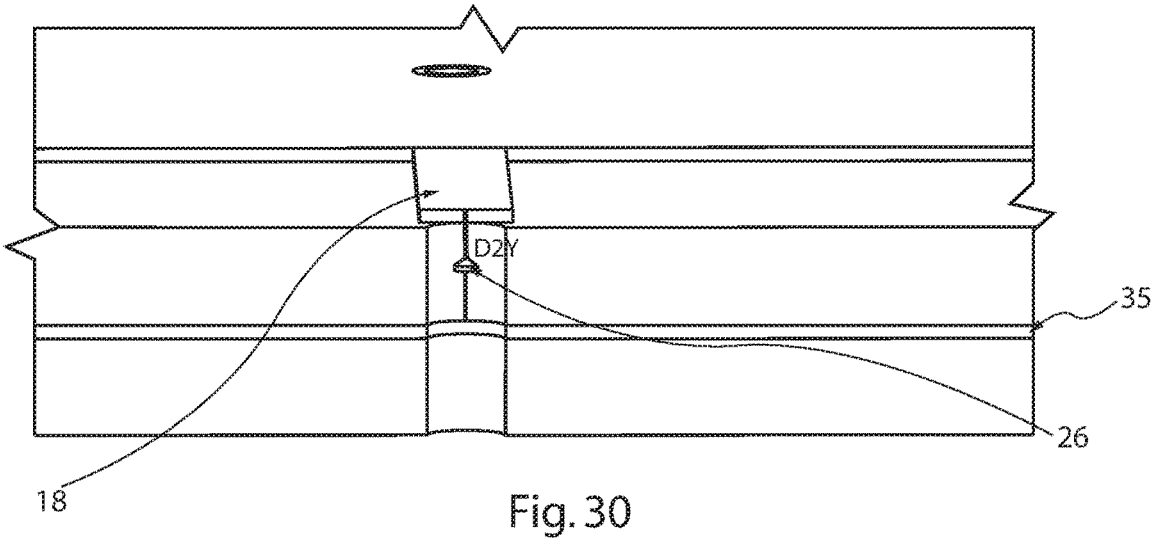
Figure 31:
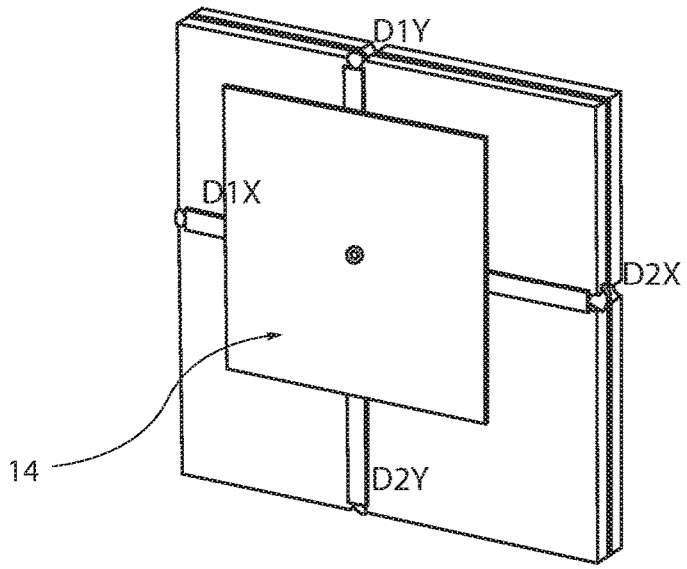

Although in the embodiments described above, the PIN diodes are coupled between the patch and the respective phase control line length, in some embodiments the PIN diodes can be coupled between the respective phase control line length and RF ground, meaning that the phase control line lengths are directly connected to the patch. Reference is made in this regard to FIG. 25 which shows such an embodiment. Note that although there appears to be shown a small section of phase control line between the diodes and connection to RF ground, this is just for clarity of the Figure. Nevertheless, as mentioned above, in some embodiments, the PIN diodes can be located within the phase control line lengths so as to selectively complete the phase control line lengths and thereby couple the patch to RF ground via the respective phase control line lengths.

In an arrangement such as FIG. 25, the PIN diodes can be placed within the via holes. Reference is made to FIGS. 26 to 31. In this embodiment, the via holes are not plated and the PIN diodes extend through the via holes, connecting their respective phase control line length to the ground layer 35.

Figure 32:
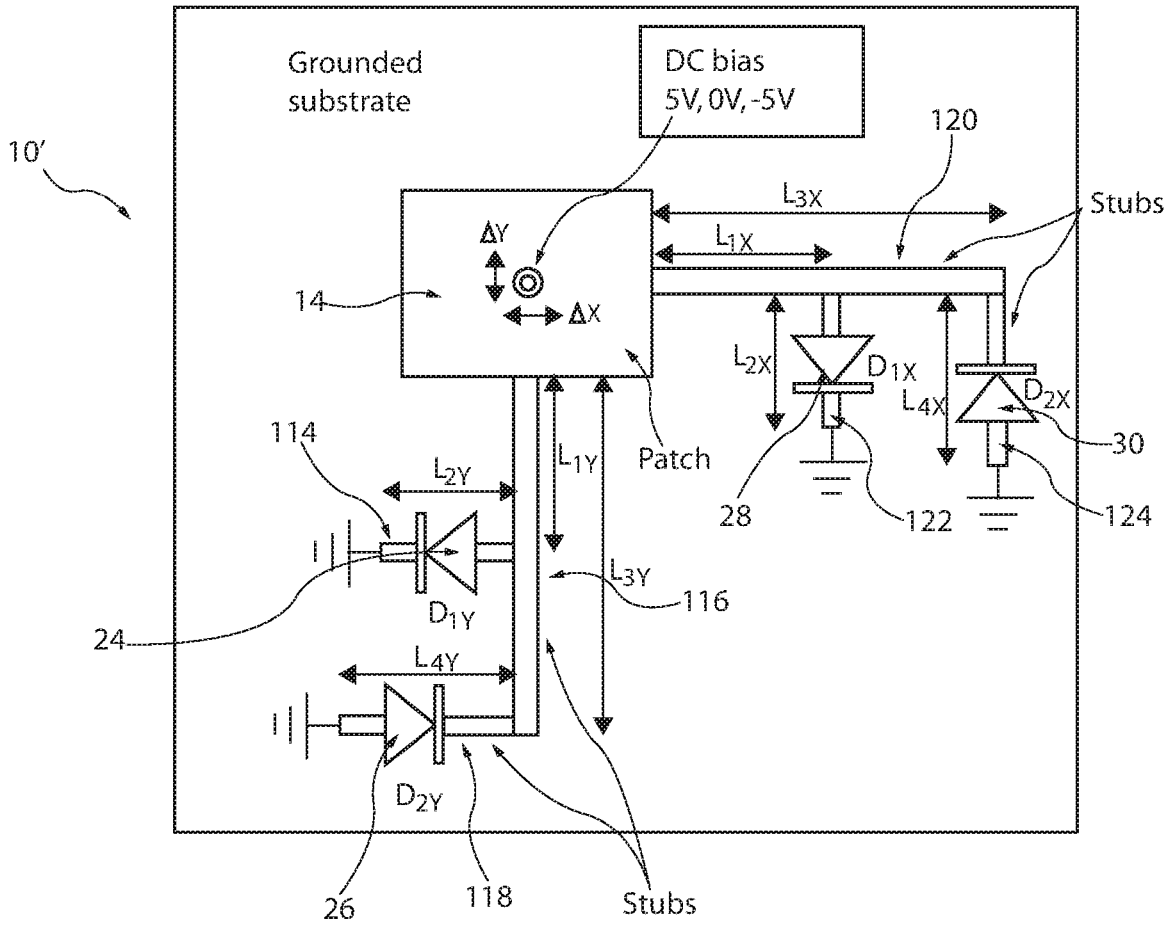
FIG. 32 shows a circuit diagram of a reflectarray antenna element according to an embodiment of the invention.

Although in the embodiments disclosed above the first and second phase control line lengths are located on opposite sides of the patch and the third and fourth phase control line lengths are located on opposite sides of the patch, this is not necessary in every embodiment. The phase control line lengths can be placed arbitrarily. However, each line will contribute to co-polarization as well as cross polarization. However, a unit cell can be designed where the copolar fields can be made to be additive while cross polar fields are cancelled. Reference is made to FIG. 32.

In the embodiment of FIG. 32, the first and second phase control line lengths share a section of phase control line. Similarly, the third and fourth phase control line lengths share a section of phase control line. The unit cell 10' includes a first phase control line section 116 directly connected to and extending from the patch 14 in the first polarization direction, and a second phase control line section 120 directly connected to and extending from the patch 14 in the second polarization direction.

The unit cell 10' also includes third and fourth phase control line sections 114, 118 extending from the first phase control line section, in this case in the second polarization direction, between the first phase control line section and RF ground, and fifth and sixth phase control line sections 122, 124 extending from the second phase control line section 120, in this case in the first polarization direction, between the second phase control line section and RF ground.

The first PIN diode 24 is provided within the third phase control line section, the second PIN diode 26 is provided within the fourth phase control line section, the third PIN diode 28 is provided within the fifth phase control line section, and the fourth PIN diode 30 is provided within the sixth phase control line section. $L_{1Y}$ is the length of the first phase control line section from the patch to the third phase control line section.

$L_{2Y}$ is the length of the third phase control line section.

$L_{3Y}$ is the length of the first phase control line section from the patch to the fourth phase control line section.

$L_{4Y}$ is the length of the fourth phase control line section.

$L_{1X}$ is the length of the second phase control line section from the patch to the fifth phase control line section.

$L_{2X}$ is the length of the fifth phase control line section.

$L_{3X}$ is the length of the second phase control line section from the patch to the sixth phase control line section.

$L_{4X}$ is the length of the sixth phase control line section.

For Y Polarization:

The first phase control line effective length=$L_{1Y}+L_{2Y}$

The second phase control line effective length=$L_{3Y}+L_{4Y}$ $L_{2Y}$ and $L_{4Y}$ can be both zero or non-zero. Alternatively, either of them can be zero and the remaining can be non-zero.

The first phase control line section 116 provides $L_{1Y}$ and $L_{3Y}$ which are the main phase control line section lengths for Y polarization and which can be adjusted as per the required phase shift. Their length is changed in dependence upon whether $L_{2Y}$ and $L_{4Y}$ are zero or non-zero.

For X Polarization:

The third phase control line effective length=$L_{1X}+L_{2X}$

The fourth phase control line effective length=$L_{3X}+L_{4X}$ $L_{2X}$ and $L_{4X}$ can be both zero or non-zero. Alternatively either of them can be zero and the remaining can be non-zero.

The second phase control line section 120 provides $L_{1X}$ and $L_{3X}$ which are the main phase control line section lengths for X polarization and which can be adjusted as per required phase shift. Their length is changed in dependence upon whether $L_{2X}$ and $L_{4X}$ are zero or non-zero.

The diode operation remains same as for the main embodiment described above.

The width of the stubs can be different. For this reason, one is shown as thick and other is shown as thin.

The diodes should be sufficiently separated so they appear isolated to each other at the wavelength of interest.

The DC bias line can be moved to any appropriate location even at the stubs, depending on the design. It means the DC bias line does not necessarily have to be on the patch itself.

There can be many combinations of diode placements for example on the same side of the stub ($L_{3Y}$ or $L_{3X}$) or on opposite sides.

The diodes can be mounted with extra stubs (114, 118, 122, 124) as shown (for example $L_{2Y}$ and $L_{4Y}$ here) or can be mounted directly on the main stub 116, 120 (the stub with length $L_{3Y}$, or $L_{3X}$).

In the embodiment of FIG. 32, to accommodate the single sided placement of the diodes, it is preferred to provide the required shift to the DC bias line from the centre to achieve lower cross polarization in their configuration.

Although in the preferred embodiments described above the switching devices are PIN diodes, other switching devices can be used in other embodiments. For example, MEMS devices or CMOS devices (such as FETs or transistors) can be used. Suitable criteria for choosing switching devices include that they should be small in size, have minimal power consumption, minimum insertion loss, and ease of DC biasing. PIN diodes traditionally consume a lot of power. However, their DC current is controlled in the preferred embodiment by controlling their DC drive current and voltage to lower the DC power consumption.

In the embodiments discussed above, the PIN diodes are switched by variation of a DC bias input applied to the patch, which creates a DC voltage across the PIN diodes between the patch and ground. However, in other embodiments, it is possible to control the switching devices in other ways. For example, each switching device may be controlled by its own respective bias voltage. Each device may have its own bias terminals and DC voltage. This may be appropriate for example if the switching devices are RF MEMS, for which each switching device would need a separate DC bias line. In such cases, the patch itself may not need a DC voltage. In addition or alternatively, it is not excluded that the phase control line lengths could be coupled between the patch and different stable potentials, provided that the PIN diodes and DC input voltage levels are appropriately configured to ensure the desired conductive and non-conductive states of the PIN diodes are still achieved. This enables having different PIN diodes in the same design. For certain PIN diodes its anode should be at 1.5V higher than the cathode. For certain NPN Transistors, its base should be 0.7V higher than the emitter. The operation of FET and PNP transistor can be though on similar lines to operate them by biasing.

The patch in itself does not need DC bias. It can be used as one of the terminals for DC biasing of the connected switching devices where appropriate.

The PIN diode or switching device should have DC bias. It generally requires two terminals, where one terminal is connected to one side of the DC supply, while the other terminal is connected to the other side of the DC supply. This can happen through the phasing lines as they are conductors. DC bias controls the geometry by switching the parts of the structure into or out of the whole geometry. Once this geometry is changed one can generate different states.

However, the switches are controlled to provide the reflection phase states in the manner disclosed above in respect of the preferred embodiments.

The embodiments described in detail above are preferred as they are easier to produce for mm-waves. It is not easy to implement/route multiple DC bias lines at mm-waves due to the physical space available. Furthermore, the diodes which operate with the given one voltage level should be preferably similar, otherwise one of them may have a higher voltage, which may increase power consumption.

In the above description, the results for horizontal and vertical polarizations are similar, as the design frequency for both is the same. This is because the lengths that affect the vertical polarization are the same as the counterpart lengths that affect the horizontal polarization. However, they can be different and the design frequency can therefore be different. Embodiments are capable of generating three phase states for each polarization operating at different frequencies. For Example Polarization 1 has Frequency 1, while Polarization 2 can have Frequency 2, where Frequency 1 may or may not be equal to Frequency 2. The worst case of cross polarization is observed when both frequencies are same. When frequencies are made different, the cross polarization gets better. When frequencies are different the X and Y offsets can be adjusted accordingly. In the preferred embodiment discussed above the X and Y offsets are similar.

Although the above embodiments provide for first and second polarisations, in some embodiments it is possible to omit the components relating to one of the polarisations and provide an antenna element configured to work with a single polarization. When it is configured with single polarization, the cross polarization can be significantly improved by a single offset from centre.

In addition, it is possible to configure the antenna element to work with circularly or elliptically polarized radiation. In such a case, the phase control line lengths and the unit cell shape can be tailored to provide that functionality. In order to work with circularly or elliptically polarized radiation, both the X and Y components disclosed above can be used together for the single polarisation. For circular polarisation, the X and Y components are orthogonal. For elliptically polarized radiation, they can be at other angles.

Instead of having the ground layer on the second side of the first substrate, it can be disposed on the first side of the second substrate or on the first side of the first substrate (the top layer), provided the PIN diodes have a return connection for DC bias.

Although the above described embodiments include three layers, in some embodiments, only two layers are provided and the second substrate and third layer can be omitted. In such embodiments, the DC isolation element can be implemented on the second layer. The RF-DC isolation can in other embodiments be implemented in many other ways. However, having the DC isolation element at a third layer as described above provides good RF performance.

It is possible to scale up and down the design for the intended frequency range. The switching devices to be used should be chosen so as to operate at the desired frequency.

All optional and preferred features and modifications of the described embodiments and dependent claims are usable in all aspects and embodiments of the invention taught herein. Furthermore, the individual features of the dependent claims, as well as all optional and preferred features and modifications of the described embodiments are combinable and interchangeable with one another.

The disclosures in British patent application number GB1811092.4, which this application claims priority, and in the abstract accompanying this application are incorporated herein by reference.

The invention claimed is:

1. A reflectarray antenna element including:

a patch of electrically conductive material for reflecting an electromagnetic field;

a dielectric substrate providing an RF ground;

first and second phase control lines of electrically conductive material arranged to interact with electromagnetic radiation with a first polarisation;

a first binary switching device having an ON or OFF state disposed between the patch and ground, and configured to selectively electrically couple the patch to ground via the first phase control line;

a second binary switching device having an ON or OFF state disposed between the patch and ground, and configured to selectively electrically couple the patch to ground via the second phase control line;

wherein the first switching device is a first PIN diode having a diode direction from the patch to the ground; and the second switching device is a second PIN diode having a diode direction from the ground to the patch;

a single DC bias input electrically coupled to the patch and configurable to different discrete voltage levels for selectively controlling the states of the switching devices;

wherein selective operation of the first and second binary switching devices by means of the DC bias input provides phase control of electromagnetic radiation dependent on the state of the switching devices configured to provide three phase states for electromagnetic radiation for each polarisation and frequency.

2. The antenna element of claim 1, wherein operation of the first and second switching devices causes the reflectarray antenna element to generate phase controlled electromagnetic radiation at the first polarisation.

3. The antenna element of claim 1, wherein the first and second phase control lines are arranged parallel to a first direction and each line in the first direction has a length, enabling the first and second phase lines operate at a first frequency.

4. The antenna element of claim 3, wherein the patch has a length and a width, the first and second phase control lines are disposed in the first direction along one of the length and width of the patch.

5. The antenna element of claim 1, wherein the dielectric substrate is configured with the patch on one side thereof and RF ground on the other side thereof and ground is provided by an electrically conductive layer substantially parallel to the patch.

6. The antenna element of claim 1, including:

third and fourth phase control lines of electrically conductive material;

a third binary switching device having an ON or OFF state disposed between the patch and ground and configured to selectively electrically couple the patch to ground via the third phase control line;

a fourth binary switching device having an ON or OFF state disposed between the patch and ground and configured to selectively electrically couple the patch to ground via the fourth phase control line;

wherein the third switching device is a third PIN diode having a diode direction from the patch to the ground; and the fourth switching device is a fourth PIN diode having a diode direction from the ground to the patch;

wherein the single DC bias input provides for selectively controlling the states of the third and fourth switching devices.

7. The antenna element of claim 6, wherein the third and fourth phase control lines are arranged to interact with electromagnetic radiation with a second polarisation and the third and fourth phase control lines are arranged parallel to a second direction.

8. The antenna element of claim 7, wherein operation of the third and fourth binary switching devices causes the reflectarray antenna element to generate phase controlled electromagnetic radiation at the second polarisation.

9. The antenna element of claim 8, wherein the patch has a length and a width, the first and second phase control lines are disposed in a first direction along one of the length and width of the patch and the third and fourth phase control lines are disposed in the second direction along the other of the length and width of the patch.

10. The antenna element of claim 6 wherein each line in the second direction has a length, enabling the third and fourth phase lines operate at a second frequency.

11. The antenna element of claim 6, wherein the third phase control line is selectively electrically couplable to the patch by the third switching device and the fourth phase control line is selectively electrically couplable to the patch by the fourth switching device.

12. The antenna element of claim 1, wherein the DC bias input is offset from a centre of the patch in a first direction by a distance which reduces cross-polarisation of a first electromagnetic field and is offset from a centre of the patch in a second direction by a distance which reduces cross-polarisation of a second electromagnetic field, wherein the first direction is a direction of polarisation of the first polarisation and the second direction is a direction of polarisation of a second polarisation.

13. The antenna element of claim 1, configured to implement 1.5 bits phase control to provide three phase states for electromagnetic radiation with the first polarisation at the first frequency, and optionally also for electromagnetic radiation with a second polarisation at a second frequency, directly at the RF plane of the antenna element.

14. The antenna element of claim 1, including a substrate structure including first and second layers, the patch being located in the first layer, the second layer being said ground, and including a third layer; wherein the DC bias input includes a conductive via linking the first and third layers without electrical connection to the ground layer.

15. A reflectarray including a plurality of antenna elements, each antenna element including:

a patch of electrically conductive material for reflecting an electromagnetic field;

a dielectric substrate providing an RF ground;

first and second phase control lines of electrically conductive material arranged to interact with electromagnetic radiation with a first polarisation;

a first binary switching device having an ON or OFF state disposed between the patch and ground, and configured to selectively electrically couple the patch to ground via the first phase control line;

a second binary switching device having an ON or OFF state disposed between the patch and ground, and configured to selectively electrically couple the patch to ground via the second phase control line;

wherein the first switching device is a first PIN diode having a diode direction from the patch to the ground; and the second switching device is a second PIN diode having a diode direction from the ground to the patch;

a single DC bias input electrically coupled to the patch and configurable to different discrete voltage levels for selectively controlling the states of the switching devices;

wherein selective operation of the first and second binary switching devices by means of the DC bias input provides phase control of electromagnetic radiation dependent on the state of the switching devices configured to provide three phase states for electromagnetic radiation for each polarisation and frequency.

16. The reflectarray according to claim 15, wherein for each antenna element: the antenna element includes a substrate structure including first and second layers, the patch is located in the first layer, the second layer is said ground, each of the phase control lines is electrically coupled to ground through a via linking the first and second layers.

17. The reflectarray according to claim 15, wherein adjacent antenna elements share a via.

18. The reflectarray according to claim 15, including a control system configured to control the voltage level of the DC bias input of each of the antenna elements.

19. The reflectarray according to claim 15, wherein at least some of the antenna elements are configured to provide different reflection phase shifts from others.

20. A method of operating an antenna element, the antenna element including:

a patch of electrically conductive material for reflecting an electromagnetic field;

a dielectric substrate providing an RF ground;

first and second phase control lines of electrically conductive material arranged to interact with electromagnetic radiation with a first polarisation;

a first binary switching device having an ON or OFF state disposed between the patch and ground, and configured to selectively electrically couple the patch to ground via the first phase control line;

a second binary switching device having an ON or OFF state disposed between the patch and ground, and configured to selectively electrically couple the patch to ground via the second phase control line;

wherein the first switching device is a first PIN diode having a diode direction from the patch to the ground; and the second switching device is a second PIN diode having a diode direction from the ground to the patch;

a single DC bias input electrically coupled to the patch and configurable to different discrete voltage levels for selectively controlling the states of the switching devices;

wherein selective operation of the first and second binary switching devices by means of the DC bias input provides phase control of electromagnetic radiation dependent on the state of the switching devices configured to provide three phase states for electromagnetic radiation for each polarisation and frequency;

the method including the steps of:

controlling a DC bias signal to the DC bias input to provide a desired reflection phase control for electromagnetic radiation with the first polarisation at a first frequency and optionally also for electromagnetic radiation with a second polarisation at a second frequency.

21. The method of claim 20, including the steps of:

controlling a DC bias signal to the DC bias input of each of the reflectarray antenna elements to provide a desired reflection control for electromagnetic radiation with the first polarisation at the first frequency and optionally also for electromagnetic radiation with the second polarisation at the second frequency.

* * * * *